US009845980B2

(12) United States Patent
Wong

(10) Patent No.: US 9,845,980 B2
(45) Date of Patent: Dec. 19, 2017

(54) AIR CONDITIONING SYSTEM WITH EVAPORATIVE COOLING SYSTEM

(71) Applicant: Lee Wa Wong, Pico Rivera, CA (US)

(72) Inventor: Lee Wa Wong, Pico Rivera, CA (US)

( * ) Notice: Subject to any disclaimer, the term of this patent is extended or adjusted under 35 U.S.C. 154(b) by 730 days.

(21) Appl. No.: 14/464,546

(22) Filed: Aug. 20, 2014

(65) Prior Publication Data

US 2016/0054039 A1 Feb. 25, 2016

(51) Int. Cl.
*F25B 39/04* (2006.01)
*F25B 49/02* (2006.01)

(52) U.S. Cl.
CPC ..... *F25B 39/04* (2013.01); *F25B 49/027* (2013.01); *F25B 2339/041* (2013.01)

(58) Field of Classification Search
CPC .. F25B 39/04; F25B 49/027; F25B 2339/041; F25B 2339/046; F25B 2339/047
See application file for complete search history.

(56) References Cited

U.S. PATENT DOCUMENTS 3,864,442 A * 2/1975 Percy ..... F28C 1/14 165/160
4,182,131 A * 1/1980 Marshall ..... F24F 5/001 62/305
4,406,138 A 9/1983 Nelson
6,681,584 B1 1/2004 Conner
2013/0255290 A1 10/2013 Wu et al.
2013/0276476 A1 10/2013 Wong

* cited by examiner

*Primary Examiner* — Travis Ruby
(74) *Attorney, Agent, or Firm* — Tsz Lung Yeung

(57) ABSTRACT

An air conditioning system using a predetermined amount of refrigerant includes an evaporator unit, a compressor unit, an evaporative cooling system including at least one multiple-effect evaporative condenser connected to the compressor for effectively cooling the refrigerant. Each of the multiple-effect evaporative condensers includes an air inlet side and an air outlet side which is opposite to the air inlet side, a pumping device adapted for pumping a predetermined amount of cooling water at a predetermined flow rate, a first cooling unit and a second cooling unit. The refrigerant flows through heat exchanging pipes in the first cooling unit and the second cooling unit. The cooling water is arranged to pass through the first cooling unit and the second cooling unit in a sequential order and perform heat exchange with the refrigerant.

126 Claims, 23 Drawing Sheets

AIR CONDITIONING SYSTEM WITH EVAPORATIVE COOLING SYSTEM

BACKGROUND OF THE PRESENT INVENTION

Field of Invention

The present invention relates to an air conditioning system, and more particularly to an air conditioning system comprising a multiple-effect evaporative condenser which has a substantially improved energy efficiency and water consumption requirement as compared to conventional cooling techniques for an air conditioning system.

Description of Related Arts

Referring to FIG. 1 of the drawings, a conventional air conditioning system utilizing a cooling tower is illustrated. In a conventional air conditioning system, cooling water is pumped to flow between a condenser 1P and a cooling tower 2P through two water pipes 3P. The circulation cycles of the cooling water starts at the condenser 1P. The cooling water enters the condenser 1P through a water inlet 11P and absorbs heat from the refrigerant and is pumped out of the condenser 1P through a water outlet 12P. The water pipe 3P extends from the condenser 1P to the cooling tower 2P which is typically placed at a distance from the condenser 1P. For example, the cooling tower 2P may be placed on the roof of a building. The temperature of the cooling water entering the cooling tower 2P is arranged to be lowered in the cooling tower 2P. The difference in temperature between incoming cooling water and outgoing cooling water in the cooling tower 2P is typically in the range of 5° C.

A major disadvantage of this type of conventional air conditioning system is that the distance between the cooling tower 2P and the condenser 1P is typically very long. The condenser 1P is usually placed in the building while the water pipes 3P connecting the cooling tower 2P and the condenser 1P must extend through building structures. This leads to very high manufacturing and maintenance cost of the air conditioning system. Moreover, conventional cooling tower 2P requires high water circulation rate (approximately 0.73 $m^3$/RT·hr), and this results in high power consumption by the relevant water pump 4P.

SUMMARY OF THE PRESENT INVENTION

An objective of the present invention is to provide an air conditioning system comprising a multiple-effect evaporative condenser which is capable of effectively and efficiently rejecting heat from the air conditioning system.

An objective of the present invention is to provide an air conditioning system with a multiple-effect evaporative condenser which is small in size, light in weight, and can be conveniently and easily installed as compared with conventional central air conditioning system.

Another objective of the present invention is to provide a multiple-effect evaporative condenser for an air conditioning system which eliminates the need to have any cooling tower such as that for a typical air conditioning system. In other words, the overall manufacturing and maintenance cost of the air conditioning system can be substantially reduced.

Another objective of the present invention is to provide an air conditioning system comprising a multiple-effect evaporative condenser which utilizes a plurality of highly efficient heat exchanging pipes for providing a relatively large area of heat exchanging surfaces.

Another objective of the present invention is to provide an air conditioning system which does not require installation of any air conditioning components (such as air conditioning main unit, compressors etc.) in a building so as to allow the building to be fully utilized for its intended purpose without needing to designate predetermined space for accommodating air conditioning components or machines.

Another objective of the present invention is to provide an air conditioning system comprising a multiple-effect evaporative condenser which substantially lowers the circulating volume and the rate of cooling water, and the required power for water pumps. Thus, the present invention saves a substantial amount of energy as compared to conventional air conditioning system utilizing water towers.

Another objective of the present invention is to provide a multiple-effect evaporative condenser comprising highly efficient heat exchanging pipes each of which comprises a plurality of inner heat exchanging fins for providing relatively large contact surface area. More specifically, the highly efficient heat exchanging pipe is capable of achieving critical heat flux density for a given material of the highly efficient heat exchanging pipe.

In one aspect of the present invention, it provides an air conditioning system using a predetermined amount of refrigerant, comprising:

an evaporator unit;

a compressor unit connected to the evaporator;

an evaporative cooling system which comprises at least one multiple-effect evaporative condenser connected to the compressor for effectively cooling the refrigerant, the multiple-effect evaporative condenser comprising:

an air inlet side and an air outlet side which is opposite to the air inlet side;

a pumping device adapted for pumping a predetermined amount of cooling water at a predetermined flow rate;

a first cooling unit, comprising:

a first water collection basin for collecting the pumping deviceed from the pumping device;

a plurality of first heat exchanging pipes connected to the condenser and immersed in the first water collection basin; and a first fill material unit provided underneath the first heat exchanging pipes, wherein the cooling water collected in the first water collection basin is arranged to sequentially flow through exterior surfaces of the first heat exchanging pipes and the first fill material unit;

a second cooling unit, comprising:

a second water collection basin positioned underneath the first cooling unit for collecting the cooling water flowing from the first cooling unit;

a plurality of second heat exchanging pipes immersed in the second water collection basin; and a second fill material unit provided underneath the second heat exchanging pipes, wherein the cooling water collected in the second water collection basin is arranged to sequentially flow through exterior surfaces of the second heat exchanging pipes and the second fill material unit; and a bottom water collecting basin positioned underneath the second cooling unit for collecting the cooling water flowing from the second cooling unit, the cooling water collected in the bottom water collection tank being arranged to be guided to flow back into the first water collection basin of the first cooling unit, the refrigerant from the evaporator being arranged to flow through the first heat exchanging pipes of the first cooling unit and the second heat exchanging pipes of the second cooling unit in such a manner that the refrigerant is arranged to perform highly efficient heat exchanging process with the cooling water for lowering a temperature of the refrigerant, a predetermined amount of air being drawn from the air inlet side for performing heat exchange with the cooling water flowing through the first fill material unit and the second fill material unit for lowering a temperature of the cooling water, the air having absorbed the heat from the cooling water being discharged out of the first fill material unit and the second fill material unit through the air outlet side.

In another aspect of the present invention, it provides an evaporative cooling system comprising at least one multiple-effect evaporative condenser, which comprises:

an air inlet side and an air outlet side which is opposite to the air inlet side;

a pumping device adapted for pumping a predetermined amount of cooling water at a predetermined flow rate;

a first cooling unit, comprising:

a first water collection basin for collecting the cooling water from the pumping device;

a plurality of first heat exchanging pipes connected to the condenser and immersed in the first water collection basin; and a first fill material unit provided underneath the first heat exchanging pipes, wherein the cooling water collected in the first water collection basin is arranged to sequentially flow through exterior surfaces of the first heat exchanging pipes and the first fill material unit;

a second cooling unit, comprising:

a second water collection basin positioned underneath the first cooling unit for collecting the cooling water flowing from the first cooling unit;

a plurality of second heat exchanging pipes immersed in the second water collection basin; and a second fill material unit provided underneath the second heat exchanging pipes, wherein the cooling water collected in the second water collection basin is arranged to sequentially flow through exterior surfaces of the second heat exchanging pipes and the second fill material unit; and a bottom water collecting basin positioned underneath the second cooling unit for collecting the cooling water flowing from the second cooling unit, the cooling water collected in the bottom water collection tank being arranged to be guided to flow back into the first water collection basin of the first cooling unit, a predetermined amount of working fluid being arranged to flow through the first heat exchanging pipes of the first cooling unit and the second heat exchanging pipes of the second cooling unit in such a manner that the working fluid is arranged to perform highly efficient heat exchanging process with the cooling water for lowering a temperature of the working fluid, a predetermined amount of air being drawn from the air inlet side for performing heat exchange with the cooling water flowing through the first fill material unit and the second fill material unit for lowering a temperature of the cooling water, the air having absorbed the heat from the cooling water being discharged out of the first fill material unit and the second fill material unit through the air outlet side.

DETAILED DESCRIPTION OF THE PREFERRED EMBODIMENT

Figure 1:
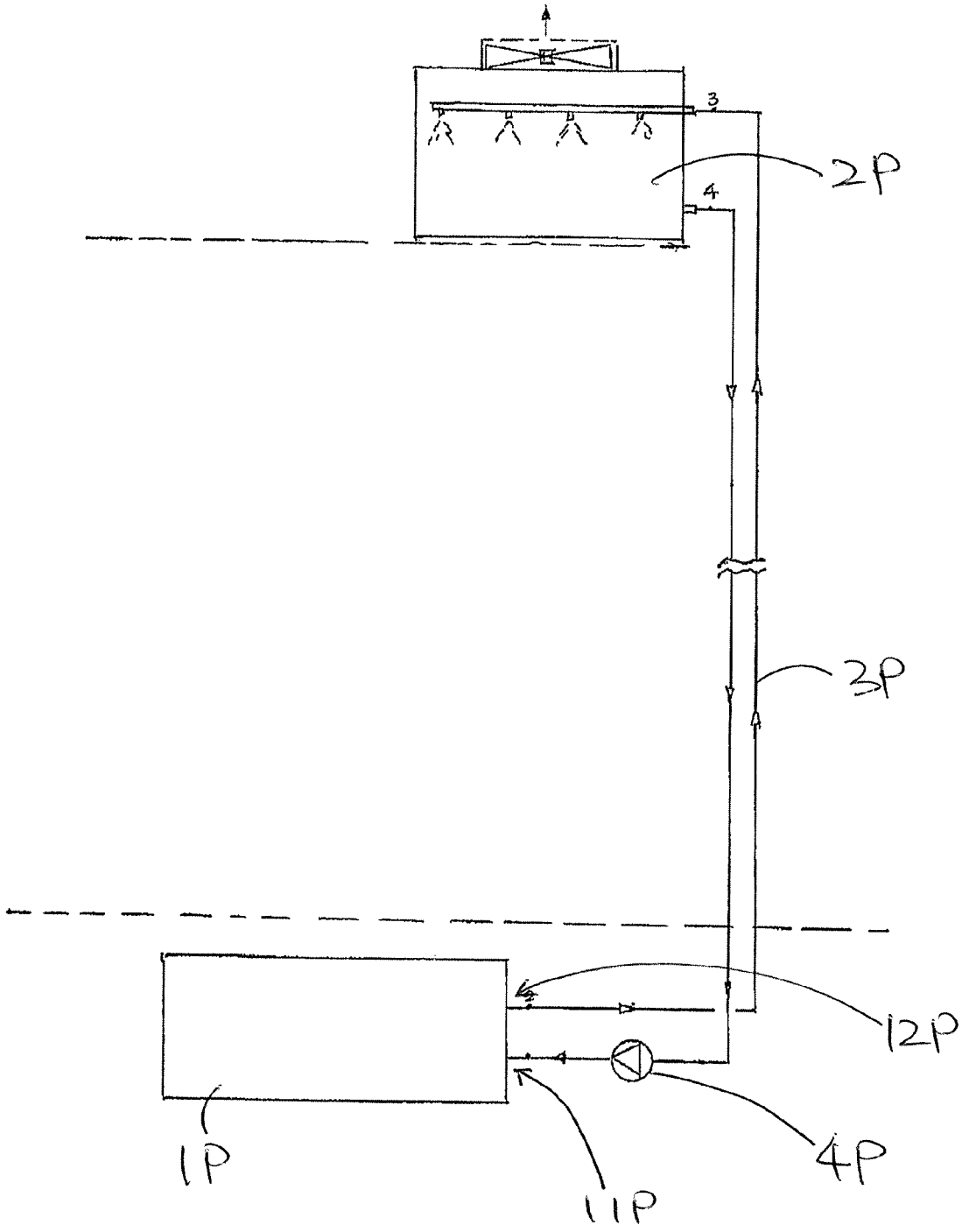
FIG. 1 PRIOR ART
FIG. 1 illustrates a conventional central air conditioning system utilizing a cooling tower.
Figure 2:
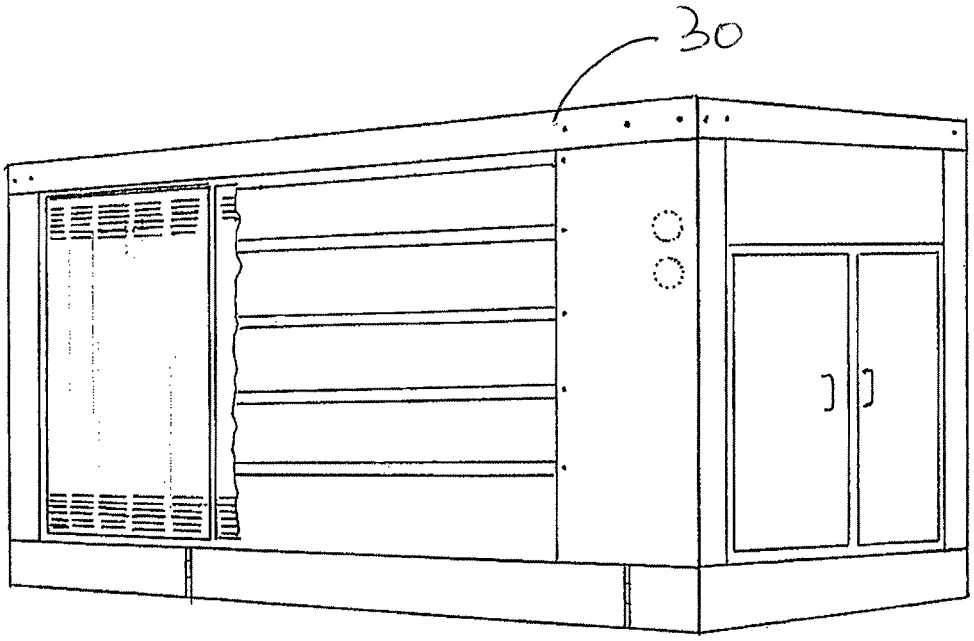
FIG. 2 is a perspective view of an air conditioning system according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 2 to FIG. 10 and FIG. 29 of the drawings, an air conditioning system according to a preferred embodiment of the present invention is illustrated. Broadly, the air conditioning system comprises two evaporator units 2, two compressor units 1, and an evaporative cooling system 200 comprising two multiple-effect evaporative condensers 5. The air conditioning system utilizes a predetermined amount of working fluid, such as a predetermined amount of refrigerant, for performing heat exchange in various components of the air conditioning system and with ambient environment.

The air conditioning system further comprises an outer housing 30 for accommodating the evaporator units 2, the two compressor units 1, and the multiple-effect evaporative condensers 5, and a plurality of cooling fans 27 provided on top of the outer housing 30.

Figure 3:
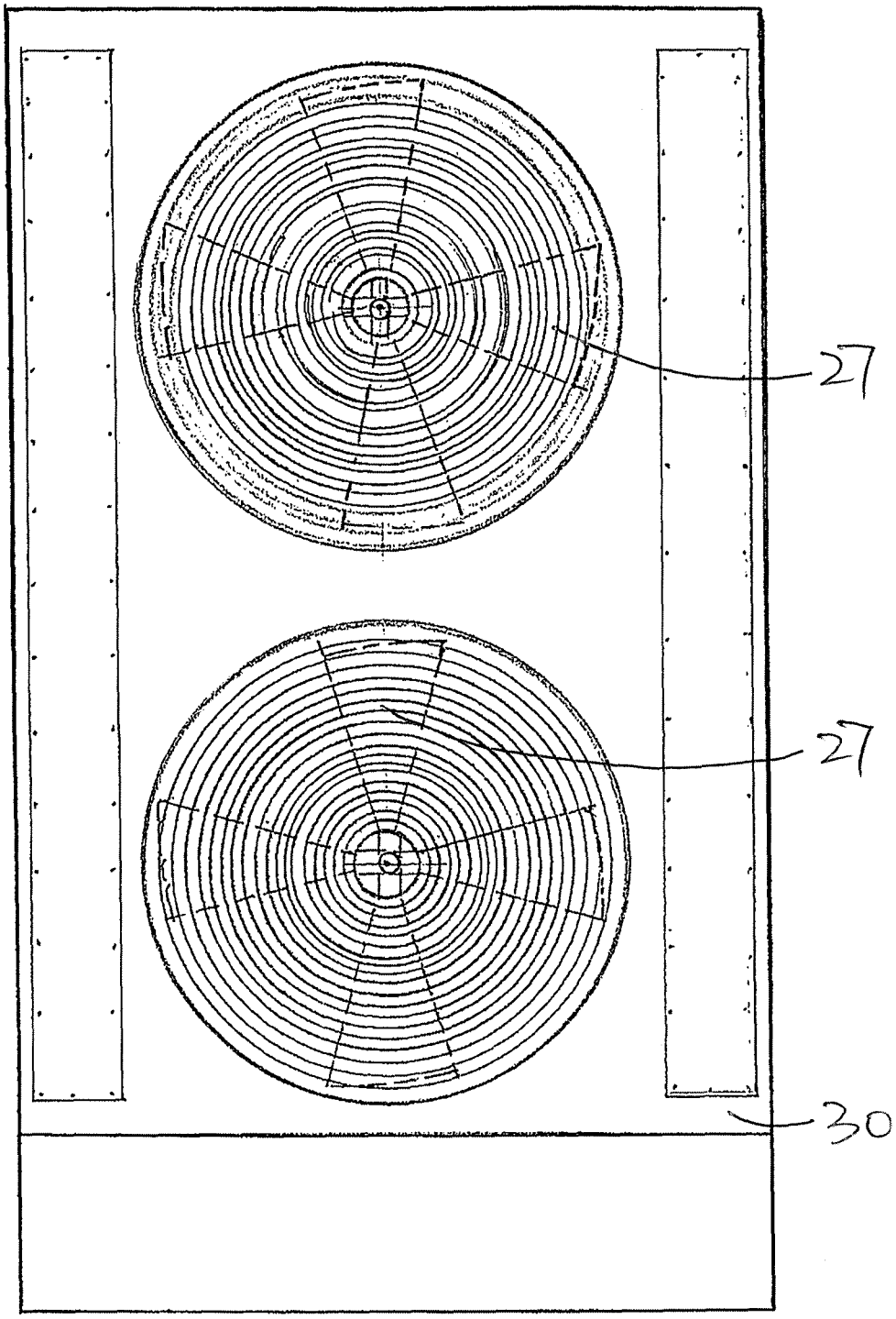
FIG. 3 is a plan view of the air conditioning system according to the preferred embodiment of the present invention.
Figure 4:
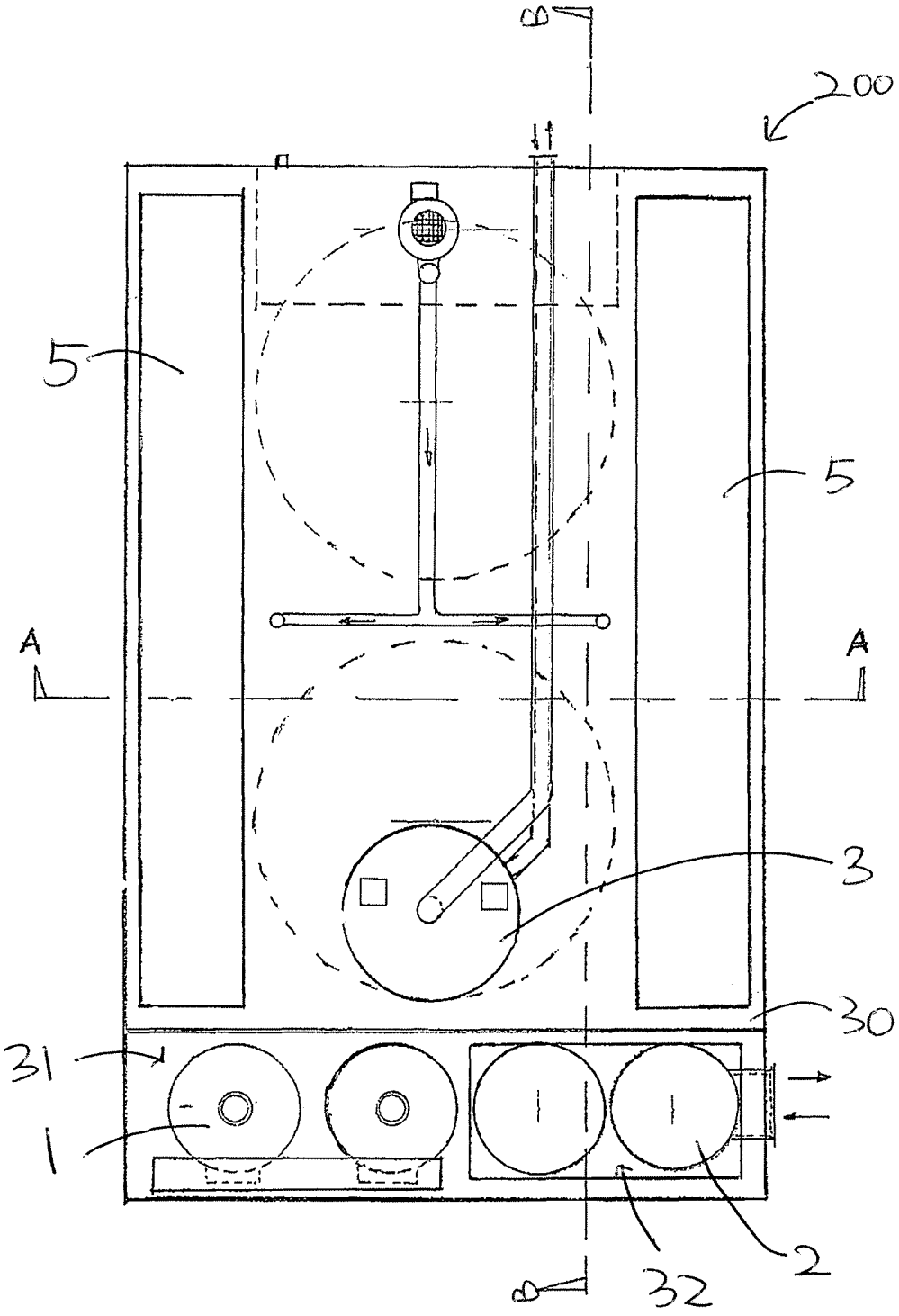
FIG. 4 is a schematic diagram of the air conditioning system according to the first preferred embodiment of the present invention.

As shown in FIG. 4 of the drawings, the outer housing 30 has a compressor compartment 31 for accommodating the compressor units 1. Preferably, there are two compressor units 1 accommodated in the compressor compartment 31. However, the number of the compressor units 1 may be varied to suit different circumstances in which the present invention is operated. The outer housing 30 further has an evaporator compartment 32 for accommodating the evaporator units 2. Preferably, there are two evaporator units 2 accommodated in the evaporator compartment 12. However, the number of the evaporator units 2 may be varied to suit different circumstances in which the present invention is operated. The compressor compartment 31 and the evaporator compartment 32 may be provided in a side-by-side manner at one transverse side of the outer housing 30 as shown in FIG. 3 of the drawings.

In this preferred embodiment, the evaporative cooling system 200 comprises two multiple-effect evaporative units 5. However, the number of the multiple-effect evaporator units 5 may also be varied to suit different circumstances in which the present invention is operated.

The multiple-effect evaporative condensers 5 are provided at two longitudinal sides of the outer housing 30 respectively and are connected to the compressor units 1 for cooling a predetermined amount of refrigerant circulating through the air conditioning system. The air conditioning system further comprises a water heater 3 positioned in the outer housing 30 between the two multiple-effect evaporator condensers 5.

Each of the multiple-effect evaporative condensers 5 comprises a pumping device 4 positioned in the outer housing 30, a first cooling unit 6, a second cooling unit 7, and a bottom water collection basin 100. Each of the multiple-effect evaporative condensers 5 also has an air inlet side 51 and an air outlet side 52 which is opposite to the air inlet side 51.

Figure 6:
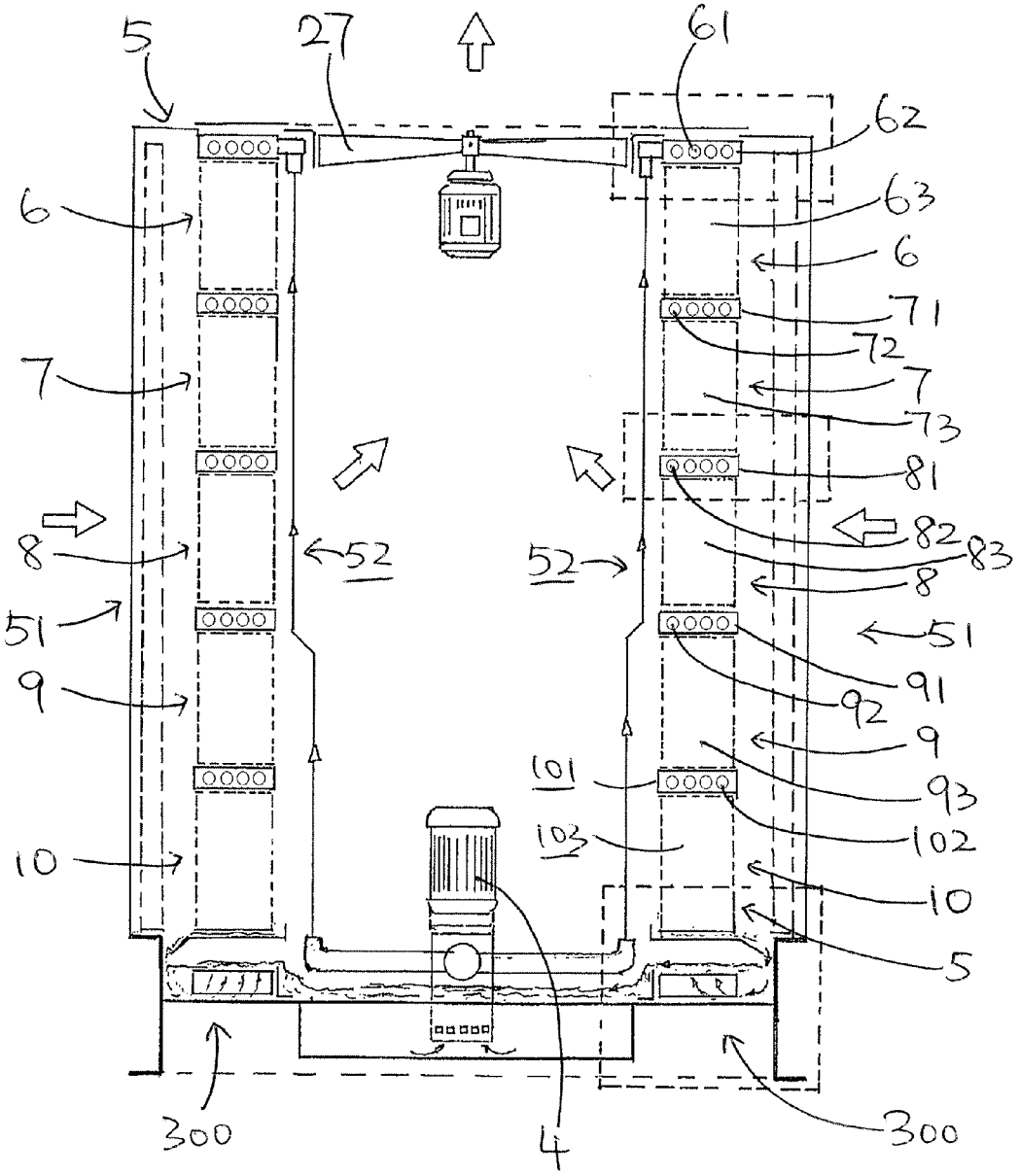
FIG. 6 is a sectional view of the air conditioning system alone plane A-A of FIG. 4, illustrating that the multiple-effect evaporative condenser has five cooling units.

The pumping device 4 is adapted for pumping a predetermined amount of cooling water at a predetermined flow rate. Each of the multiple-effect evaporative condensers 5 may have its own pumping device 4. Alternatively, several (such as two) multiple-effect evaporative condensers 5 may share one single pumping device 4 for circulating the cooling water in each of the multiple-effect evaporative condensers 5, as shown in FIG. 6 of the drawings.

Figure 9:
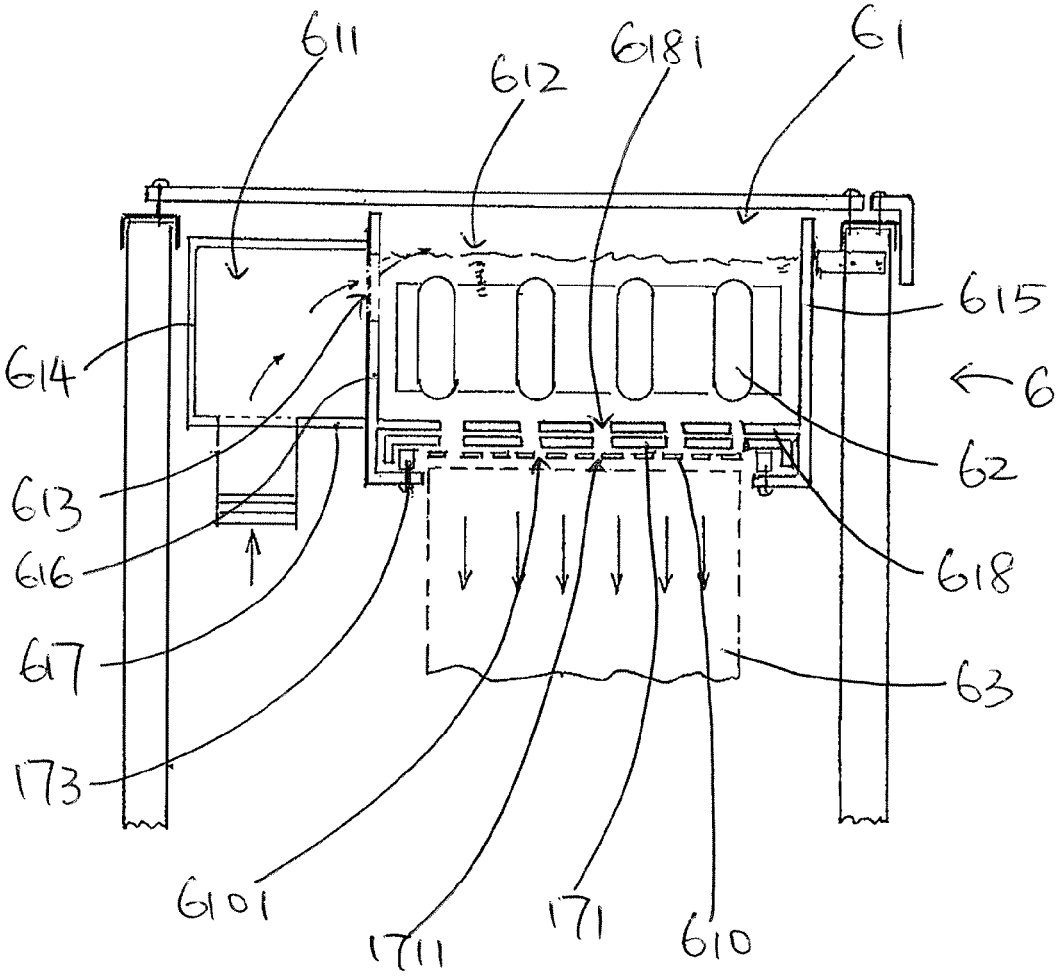
FIG. 9 is a schematic diagram of first cooling unit of the multiple-effect evaporative condenser according to the preferred embodiment of the present invention.

As shown in FIG. 9 of the drawings, the first cooling unit 6 comprises a first water collection basin 61 for collecting the cooling water from the pumping device 4, a plurality of first heat exchanging pipes 62 connected to the relevant compressor unit 1 and immersed in the first water collection basin 61, and a first fill material unit 63 provided underneath the first heat exchanging pipes 62, wherein the cooling water collected in the first water collection basin 61 is arranged to sequentially flow through exterior surfaces of the first heat exchanging pipes 62 and the first fill material unit 63 for forming a thin water film therein.

Figure 10:
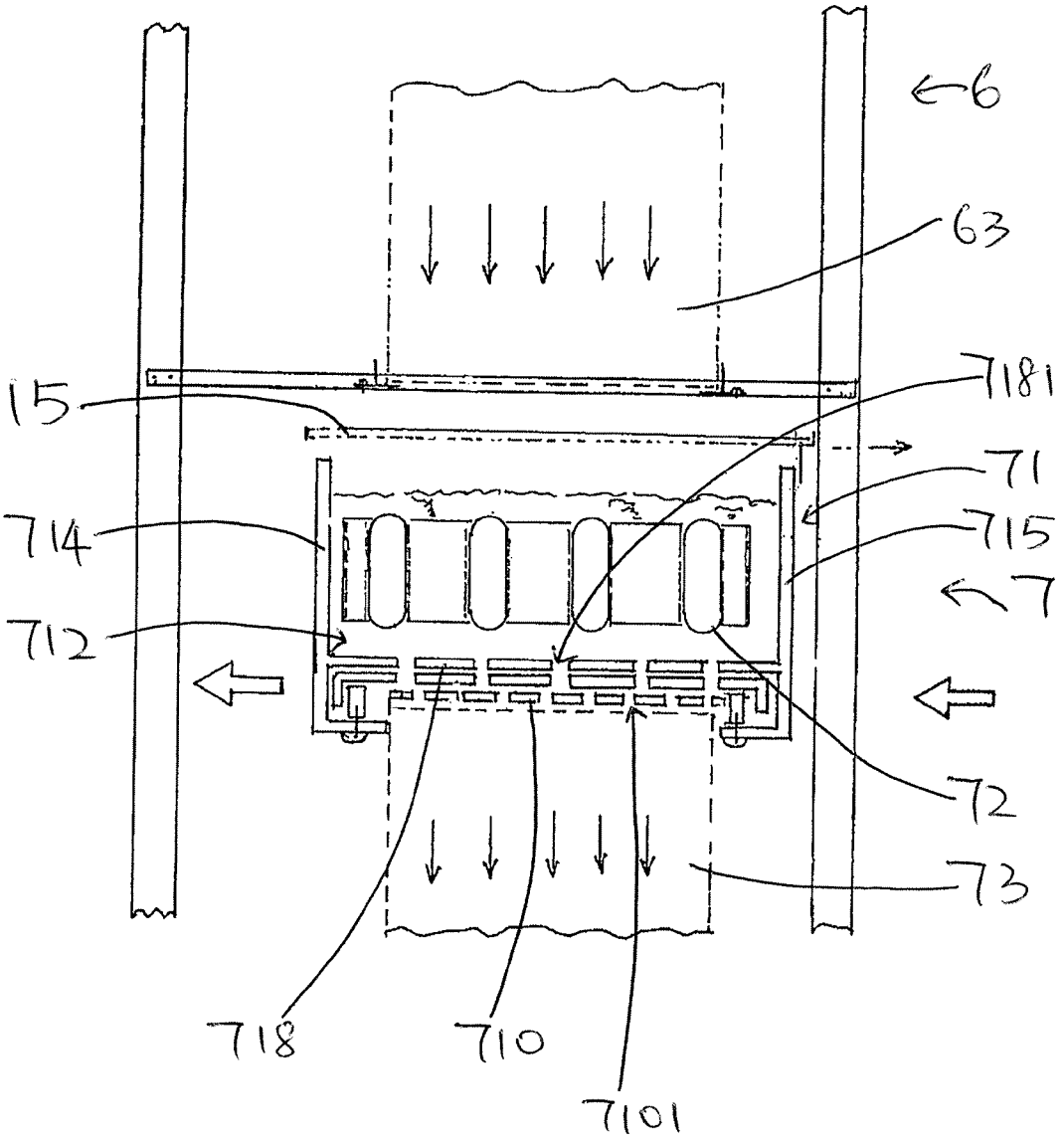
FIG. 10 is a schematic diagram of second cooling unit of the multiple-effect evaporative condenser according to the preferred embodiment of the present invention.

On the other hand, as shown in FIG. 10 of the drawings, the second cooling unit 7 comprises a second water collection basin 71 positioned underneath the first cooling unit 6 for collecting the cooling water flowing from the first cooling unit 6, a plurality of second heat exchanging pipes 72 immersed in the second water collection basin 71, and a second fill material unit 73 provided underneath the second heat exchanging pipes 72. The cooling water collected in the second water collection basin 71 is arranged to sequentially flow through exterior surfaces of the second heat exchanging pipes 72 and the second fill material unit 73 for forming a thin water film therein.

The bottom water collecting basin 300 is positioned underneath the second cooling unit 7 for collecting the cooling water flowing from the second cooling unit 7. The cooling water collected in the bottom water collection basin 100 is arranged to be guided to flow back into the first water collection basin 61 of the first cooling unit 6. On the other hand, the refrigerant from the evaporator unit 2 is arranged to flow through the first heat exchanging pipes 62 of the first cooling unit 6 and the second heat exchanging pipes 72 of the second cooling unit 7 in such a manner that the refrigerant is arranged to perform highly efficient heat exchanging process with the cooling water for lowering a temperature of the refrigerant. A predetermined amount of air is drawn from the air inlet side 51 for performing heat exchange with the cooling water flowing through the first fill material unit 63 and the second fill material unit 73 for lowering a temperature of the cooling water. The air having absorbed the heat from the cooling water is discharged out of the first fill material unit 63 and the second fill material unit 73 through the air outlet side 52.

Figure 5:
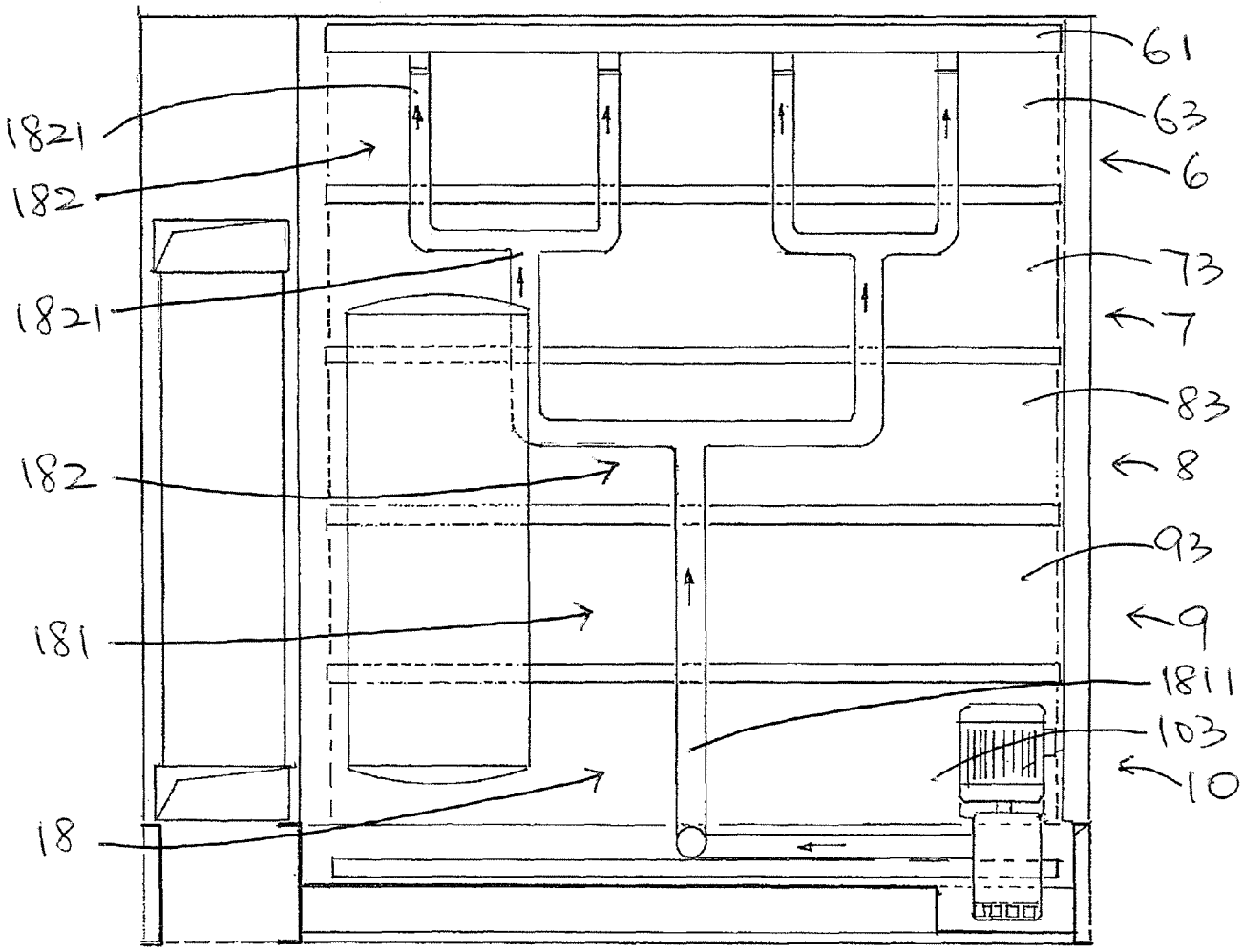
FIG. 5 is a sectional view of the air conditioning system along plane B-B of FIG. 4, illustrating that the multiple-effect evaporative condenser has five cooling units.

According to the preferred embodiment of the present invention, each of the multiple-effect evaporative condensers 5 comprises first through fifth cooling units 6, 7, 8, 9, 10. The number of cooling units utilized depend on the circumstances in which the air conditioning system is operated. FIG. 5 and FIG. 6 illustrate a situation where the multiple-effect evaporative condenser 5 comprise five cooling units, namely, the first cooling unit 6, the second cooling unit 7, the third cooling unit 8, the fourth cooling unit 9, and the fifth cooling unit 10.

Figure 7:
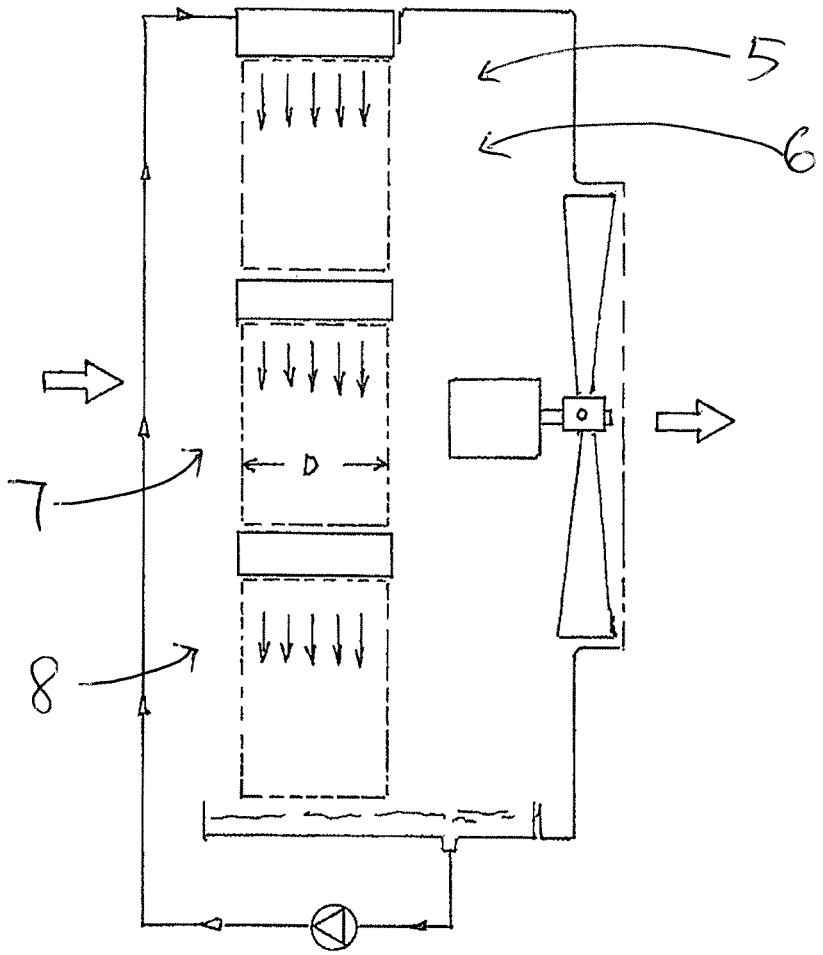
FIG. 7 is a schematic diagram of a multiple-effect evaporative condenser according to the preferred embodiment of the present invention, illustrating that the multiple-effect evaporative condenser has three cooling units.
Figure 8:
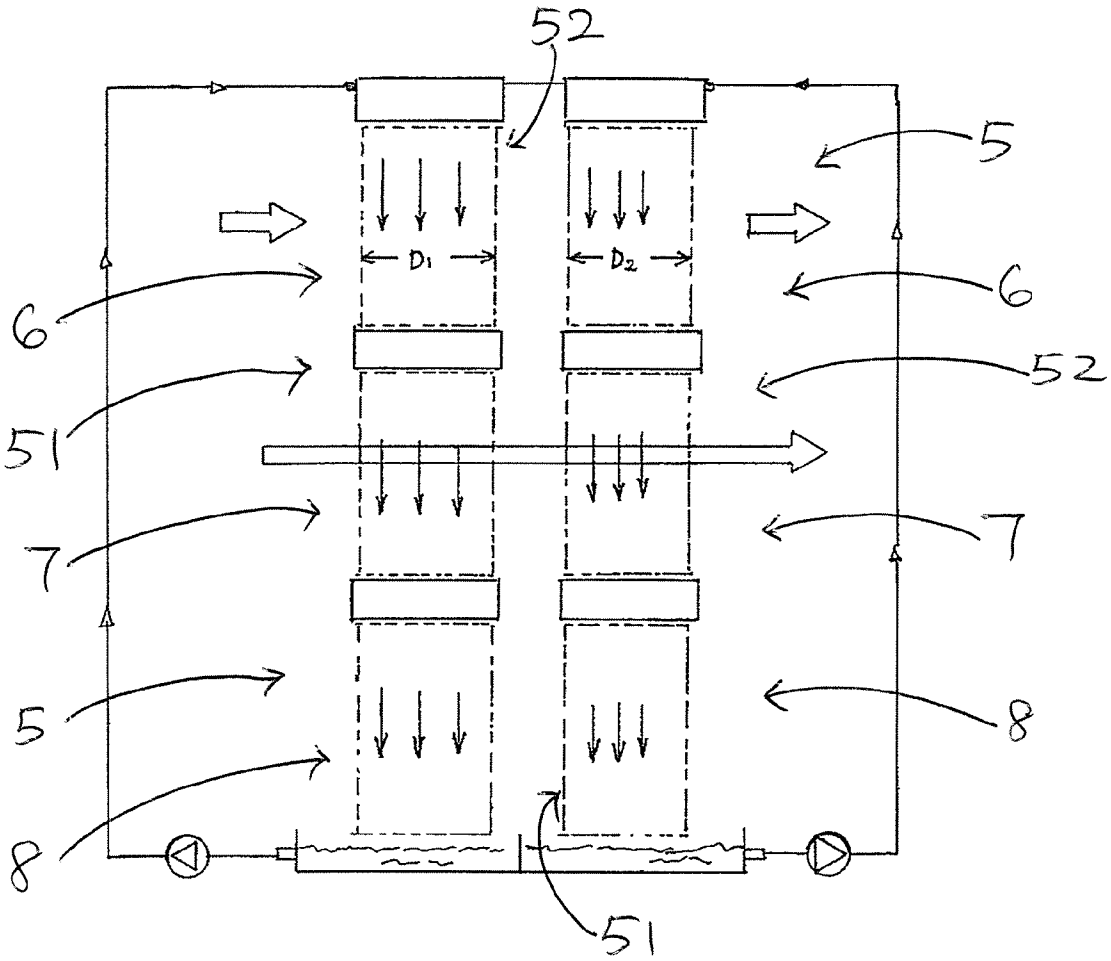
FIG. 8 is another schematic diagram of a multiple-effect evaporative condenser according to the preferred embodiment of the present invention, illustrating that the multiple-effect evaporative condenser has three cooling units.

FIG. 7 and FIG. 8 illustrate that each of the multiple-effective evaporative condenser 5 has a total of three cooling units, namely the first cooling unit 6, the second cooling unit 7, and the third cooling unit 8. From the above description, it can be shown that when the cooling water passes through one cooling unit, its temperature is arranged to increase by absorbing heat from the relevant heat exchanging pipes and is to be lowered by a predetermined temperature gradient by extracting heat to the ambient air (referred to as one "temperature cooling effect" on the cooling water), so that if the cooling water passes through five cooling units 6, 7, 8, 9, 10, the multiple-effect evaporative condenser 5 has a total of five temperature effects on the cooling water because the cooling water is heated up by the heat exchanging pipes five times and cooled down by the ambient air in the relevant fill material unit five times.

Referring back to FIG. 5 to FIG. 6 of the drawings, the third cooling unit 8 comprises a third water collection basin 81, a plurality of third heat exchanging pipes 82 immersed in the third water collection basin 81, and a third fill material unit 83 provided under the third water collection basin 81. Similarly, the fourth cooling unit 9 comprises a fourth water collection basin 91, a plurality of fourth heat exchanging pipes 92 immersed in the fourth water collection basin 91, and a fourth fill material unit 93 provided under the fourth water collection basin 91. The fifth cooling unit 10 comprises a fifth water collection basin 101, a plurality of fifth heat exchanging pipes 102 immersed in the fifth water collection basin 101, and a fifth fill material unit 103 provided under the fifth water collection basin 101. Note that where the multiple-effect evaporative condenser 5 has more than five cooling units, each of the additional cooling units will have the same structure as that of first through fifth cooling units 5, 6, 7, 8, 9, 10. For example, a sixth cooling unit may comprise a sixth water collection basin, a plurality of sixth heat exchanging pipes, and a sixth fill material unit, so on and so forth.

FIG. 5 and FIG. 6 illustrate two multiple-effect evaporative condensers 5 which are served by one common pumping device 4. Thus, the bottom water collection basin 100 of each of the multiple-effect evaporative condensers 5 is connected to the pumping device 4 so that the cooling water collected by the bottom water collection basin 100 is arranged to be pumped to the first cooling unit 6 of the respective multiple-effect evaporative condenser 5.

Each of the multiple-effect evaporative condensers 5 further comprises a pumping pipe assembly 18 connecting the pumping device 4 and the first cooling unit 6. Specifically, the pumping pipe assembly 18 has one end connected to the pumping device 4 and extends upwardly along the corresponding multiple-effect evaporative condenser 5 for guiding the cooling water to flow into the first water collection basin 61 of the first cooling unit 6. The pumping pipe assembly 18 has a main piping section 181 comprising a main pipe 1811, and a plurality of branch piping sections 182 each of which has at least one pumping pipe 1821 extended from the main pipe 1811 or a corresponding pumping pipe 1821 of the lower branch piping section 181.

As illustrated in FIG. 5 of the drawings, the pumping pipe assembly 18 has one main piping section 181 and a first branch piping section 182 upwardly extended from the main piping section 181, and a second branch piping section 182 upwardly extended from the first branch piping section 182. The first branch piping section 182 has two branch pipes 1821 bifurcated from the main pipe 1811, while the second branch piping section 182 has four branch pipes 1821, two of which are extended from one of the branch pipes 1821 of the first branch piping section 182, while the other two branch pipes 1821 are extended from another branch pipe 1821 of the first branch piping section 182.

It is important to note that the number of branch piping sections 182 depend on the height and length of the multiple-effect evaporative condenser 5 and can be varied according to different circumstances. The purpose of the pumping pipe assembly 18 is to control the flow rate of the cooling water and to allow the cooling water to be evenly and controllably distributed along a longitudinal length of the first water collection basin 61.

As one may appreciate, each of the branch pipes 1821 is extended from a corresponding branch pipe 1821 of a lower branch piping section 182 or the main pipe 1811, so that the flow rate of the cooling water gradually reduces when the cooling water travels up along the pumping pipe assembly 18.

Referring to FIG. 4 and FIG. 6 of the drawings, two multiple-effect evaporative condensers 5 are illustrated. For the sake of clarity, the two multiple-effect evaporative condensers 5 are named first multiple-effect evaporative condenser 5 and second multiple-effect evaporative condenser 5 in the following descriptions. The first and the second multiple-effect evaporative condensers 5 are structurally identical and are spacedly accommodated in the outer housing 30 in such a manner that their air outlet sides 52 face each other.

The cooling water is pumped by the pumping device 4 to flow into the first water collection basin 61 of the first cooling unit 6 through the pumping pipe assembly 18. The cooling water is arranged to perform heat exchange with the refrigerant flowing through the first heat exchanging pipes 62 and absorb a certain amount of heat. The cooling water is then allowed to flow into the first fill material unit 63 where it forms thin water film under the influence of gravity. The water film performs heat exchange with the air draft so that heat is extracted from the cooling water to the ambient air. The cooling water is then guided to flow into the second water collection basin 71 of the second cooling unit 7 and performs another cycle of heat exchange with the refrigerant flowing through the second heat exchanging pipes 72 and in the second fill material unit 73. The cooling water is guided to sequentially flow through first through fifth cooling unit 6, 7, 8, 9, 10 to absorb heat from the refrigerant flowing through the various heat exchanging pipes. The absorbed heat is subsequently extracted to ambient air in the various fill material units.

Figure 11:
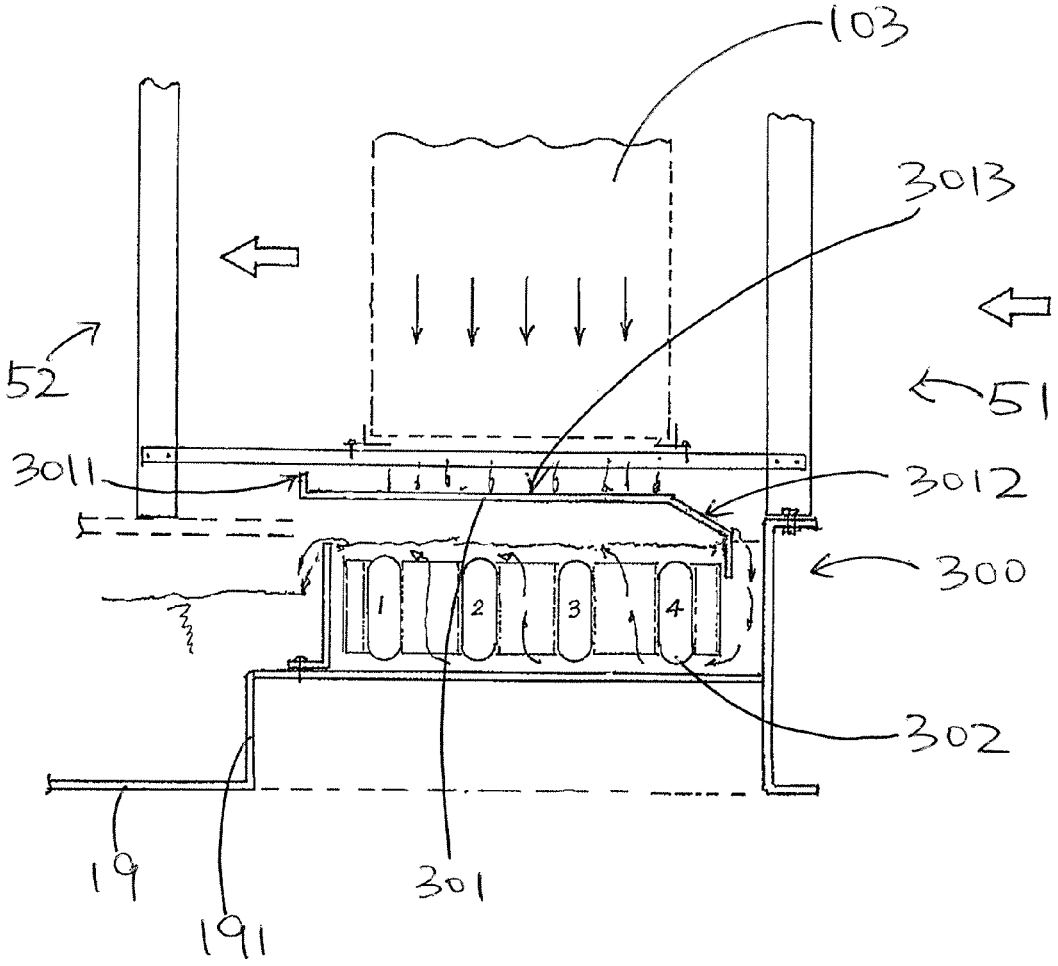
FIG. 11 is a schematic diagram of bottom cooling unit of the multiple-effect evaporative condenser according to the preferred embodiment of the present invention.

As shown in FIG. 11 of the drawings, each of the multiple-effect evaporative condensers 5 further comprises a bottom cooling unit 300 provided underneath the fifth cooling unit 10 for providing additional cooling of the refrigerant. The bottom cooling unit 300 comprises a guiding member 301, and a plurality of bottom heat exchanging pipes 302 immersed in the bottom water collection basin 100. The refrigerant passing through the bottom heat exchanging pipes 302 are arranged to perform heat exchange with the cooling water contained in the bottom water collection basin 100.

The guiding member 301 has a blocking portion 3011, an inclined guiding portion 3012, and a horizontal guiding portion 3013 extended between the blocking portion 3011 and the inclined guiding portion 3012. The blocking portion 3011 is upwardly extended from one end of the horizontal guiding portion 3013, while the inclined guiding portion 3012 is downwardly extended from another end of the horizontal guiding portion 3013. The guiding member 301 is positioned underneath the fifth cooling unit 10 and above the bottom water collection basin 100. Optimally, the horizontal guiding portion 3013 should be positioned above the cooling water level by approximately 3 mm to 6 mm. When cooling water falls from the fifth cooling unit 10 and reaches the horizontal guiding portion 3013, the cooling water is blocked from falling into the bottom water collection basin 100 from the end where the blocking portion 3011 is positioned because the cooling water is blocked by the blocking portion 3011. Thus, the cooling water is only allowed to fall into the bottom water collection basin 100 via the inclined guiding portion 3012 which is inclinedly and downwardly extended from another end of the horizontal guiding portion 3013.

In the preferred embodiment, the inclined guiding portion 3012 is provided at the air inlet side 51 of the multiple-effective evaporative condenser 5 while the blocking portion 3011 is provided at the air outlet side 52 thereof. Thus, the cooling water is guided to fall into the bottom water collection basin 100 at an outer side (i.e. the same side as the air inlet side 51) thereof. As a result, the temperature of the cooling water contained in the bottom water collection basin 100 is uneven. Since the bottom heat exchanging pipes 302 are immersed in the cooling water which falls into the bottom water collection basin 100 at one side only (i.e. outer side), the relatively cool cooling water (from the fifth cooling unit 10) is guided or forced to pass through the bottom heat exchanging pipes 302 and absorb heat from the refrigerant passing therethrough. The temperature of the cooling water increases as it absorbs heat from the refrigerant. From simple physics, one may appreciate that water having a higher temperature tends to move upward in a contained space. Thus, when the cooling water absorbs heat from the bottom heat exchanging pipes 302, it tends to move upward in the bottom water collection basin 100.

Each of the multiple-effect evaporative condensers 5 further comprises a pumping tank 19 communicated with the bottom water collection basin 100. The pumping tank 19 is positioned adjacent to an inner side (i.e. the same side as the air outlet side 52 of the multiple-effect evaporative condenser 5) of the bottom water collection basin 100 such that the relatively warmer cooling water may flow into the pumping tank 19 which also accommodate the pumping device 4. As shown in FIG. 11 of the drawings, the bottom water collection basin 100 and the pumping tank 19 share one common sidewall 191 so that the cooling water contained in the bottom water collection basin 100 is allowed to flow into the pumping tank 19 by flowing over the common sidewall 191. The cooling water then flows into the pumping tank 19 which pumps the cooling water back to the first cooling unit 6 of the relevant multiple-effect evaporative condenser 5.

It is estimated that the circulation rate of the cooling water in the air conditioning system of the present invention is approximately one-fifth of that of conventional air conditioning system having a cooling tower.

As shown in FIG. 9 of the drawings, the first water collection basin 61 has a first stabilizing compartment 611 connected to the pumping pipe assembly 18, a first heat exchanging compartment 612 provided adjacent to and communicated with the first stabilizing compartment 611 via a first water channel 613, wherein the first heat exchanging pipes 62 are immersed in the first heat exchanging compartment 612. The cooling water pumped by the pumping device 4 is guided to flow into the first stabilizing compartment 611. When the stabilizing compartment 611 is filled with a predetermined amount of cooling water which reaches the first water channel 613, the cooling water flows into the heat exchanging compartment 612 through the first water channel 613. The purpose of the first stabilizing compartment 611 is to provide a buffer zone for controlling the flow rate and pressure of the cooling water. These parameters affect the performance of the heat exchanging process between the cooling water and the first heat exchanging pipes 62.

It is worth mentioning that the first water channel 613 should be elongated in shape and extend along a longitudinal direction of the first water collection basin 61 so as to allow the cooling water to evenly flow into the first heat exchanging compartment 612 along a longitudinal direction of the first heat exchanging pipes 62. As a result, the cooling water enters the first heat exchanging compartment 612 at an even flow rate along the entire length of the first heat exchanging pipes 62. This structural arrangement also ensures that the first heat exchanging pipes 62 are immersed in the cooling water in its entirety.

The first water collection basin 61 has a first inner sidewall 614, a first outer sidewall 615, a first partitioning wall 616, and a first bottom plate 617, and a first passage plate 618. The first partitioning wall 616 is provided between the first inner sidewall 614 and the first outer sidewall 615, and divides the first water collection basin 61 into the first stabilizing compartment 611 and the first heat exchanging compartment 612, wherein the first water channel 613 is formed on the first partitioning wall 616 along a longitudinal direction thereof. The first stabilizing compartment 611 is formed between the first inner sidewall 614, the first partitioning wall 616, and the first bottom plate 617. The first heat exchanging compartment 612 is formed by the first partitioning wall 616, the first outer sidewall 615, and the first passage plate 618.

Figure 12:
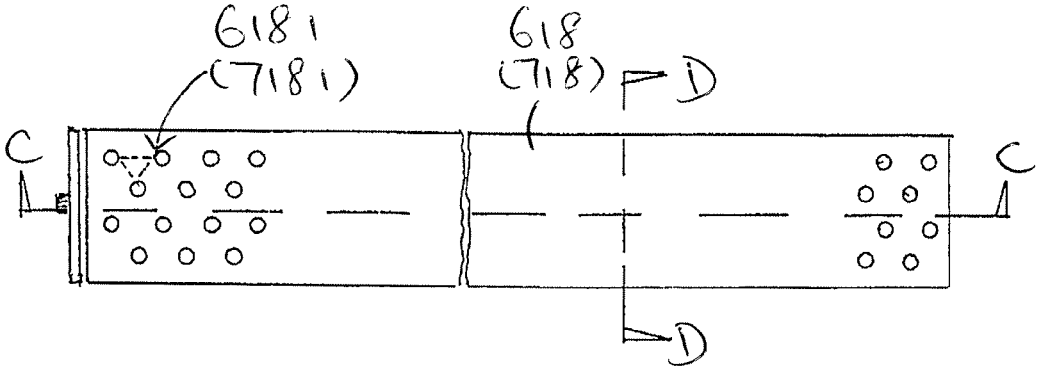
FIG. 12 is a plan view of a first passage plate of the first cooling unit according to the preferred embodiment of the present invention.

The first passage plate 618 has a plurality of first passage holes 6181 for allowing the cooling water contained in the first heat exchanging compartment 612 to fall into the first fill material unit 63. Referring to FIG. 12 of the drawings, the first passage holes 6181 are distributed along the first passage plate 618 in a predetermined array, wherein a center of each of the first passage holes 6181 in a particular row is arranged not to align with that of the first passage holes 6181 in the next row. Moreover, each two adjacent first passage holes 6181 of an upper row thereof is arranged to form a triangular distribution with a corresponding first passage hole 6181 of the adjacent row of the first passage holes 6181, as shown in FIG. 12 of the drawings. The first passage holes 6181 all have identical shape and size.

Referring to FIG. 9 to FIG. 17 of the drawings, each of the multiple-effect evaporative condensers 5 comprises a flow control mechanism 17 which comprises at least one control plate 171 movably provided underneath the first passage plate 618 of the first water collection basin 61, and at least one driving member 172 connected to the first control plate 171 for driving the control plate 171 to move in a horizontal and reciprocal manner. The control plate 171 has a plurality of control holes 1711 spacedly distributed thereon. The number, size, and shape of the control holes 1711 are identical to those of the first passage holes 6181. Moreover, centers of the first passage holes 6181 are normally aligned with those of the control holes 1711 respectively. The flow control mechanism 17 further comprises a plurality of securing members 173 mounted on the first water collection basin 61 and is arranged to normally exert an upward biasing force toward the control plate 171 so as to maintain a predetermined distance between the control plate 171 and the first passage plate 618.

In this preferred embodiment, the driving member 172 comprises an adjustment screw adjustably connected between the first water collection basin 61 and the control plate 171 for driving the control plate 171 to move in a horizontal and reciprocal manner.

Figure 13:
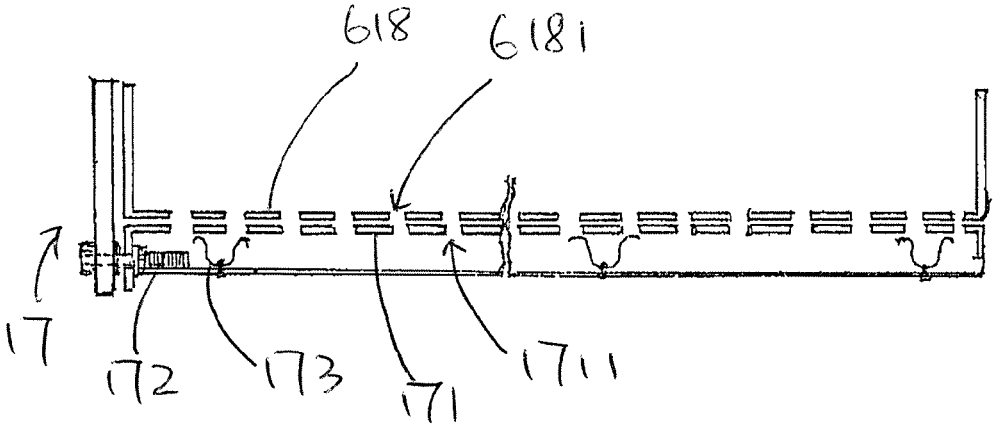
FIG. 13 is a sectional side view of a flow control mechanism of the multiple-effective evaporative condenser along plane C-C of FIG. 12, illustrating that first passage holes and first control holes are substantially aligned and overlapped respectively.
Figure 14:
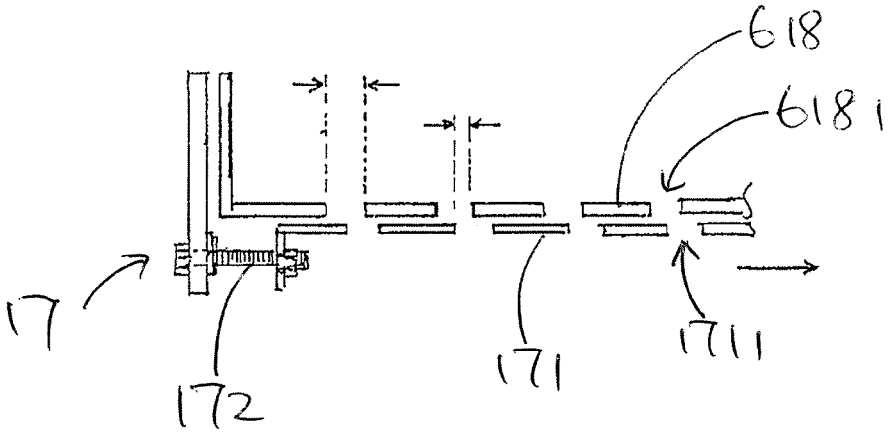
FIG. 14 is another schematic diagram of the flow control mechanism of the multiple-effective evaporative condenser according to the preferred embodiment of the present invention, illustrating that the first passage holes and the first control holes start to offset.

As shown in FIG. 13 of the drawings, when each of the first passage holes 6181 is aligned or substantially overlap with a corresponding control hole 1711, the cooling water in the first water collection basin 61 may pass through the first passage plate 618 and the control plate 171 at maximum flow rate. However, as shown in FIG. 13 and FIG. 14 of the drawings, when the control plate 171 is driven to move horizontally, the control holes 1711 and the first passages holes 6181 no longer align and flow rate of the cooling water passing through the control plate 171 and the first passage plate 618 will decrease. When the control plate 171 is moved such that each of the control holes 1711 blocks the corresponding first passage hole 6181, the flow rate of the cooling water is at its minimum, which is approximately one-third of the maximum flow rate of the cooling water.

The purpose of the flow control mechanism 17 is to control the flow rate of the cooling water flowing from the first cooling unit 6 to the second cooling unit 7, or from an upper cooling unit to a lower cooling unit. The controlled flow rate ensures that the heat exchanging pipes, such as the second heat exchanging pipes 72, can be fully immersed in the cooling water so as to perform the heat exchange process in the most effective and efficient manner.

Figure 15:
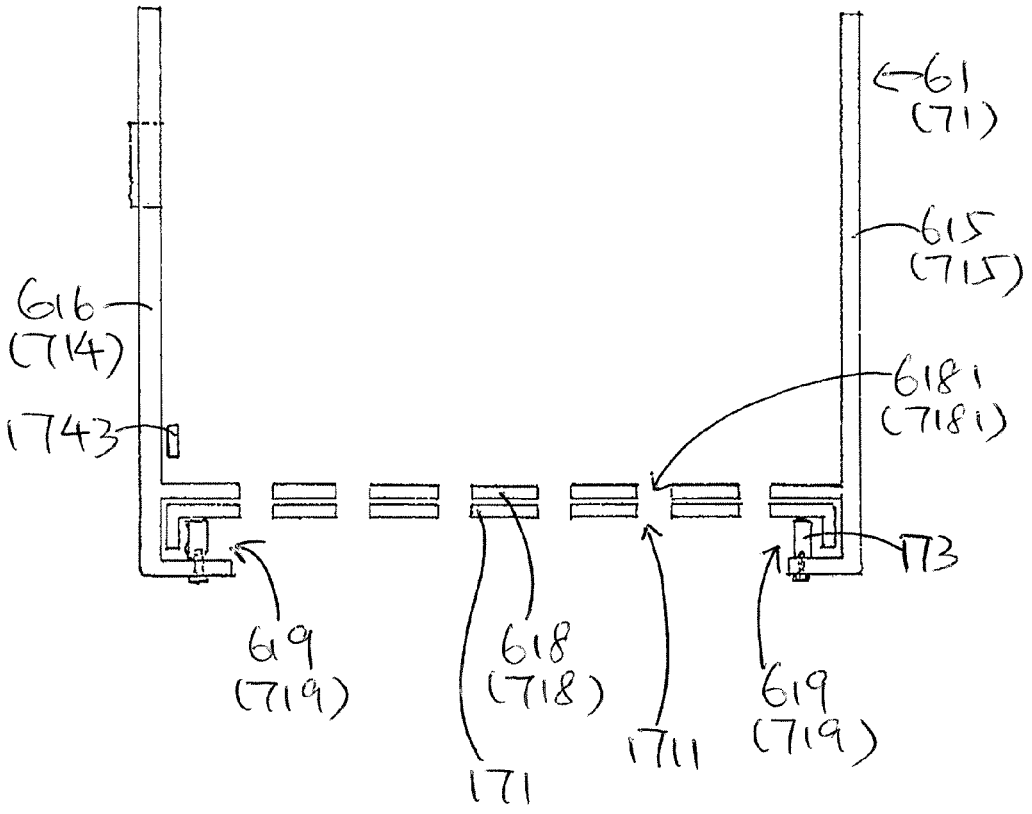
FIG. 15 is a sectional side view of a flow control mechanism of the multiple-effective evaporative condenser along plane D-D of FIG. 12.

Referring to FIG. 15 of the drawings, the first water collection basin 61 further has a pair of first securing slots 619 formed at lower portions of the first partitioning wall 616 and the first outer sidewall 615 respectively. Each of the first securing slots 619 is elongated along a longitudinal direction of the first water collection basin 61, wherein the securing members 173 are mounted in the first securing slots 619 respectively. In this preferred embodiment, each of the securing members 173 is a resilient element which normally exerts an upward biasing force against the control plate 171.

It is worth mentioning that the first water collection basin 61 (or other water collection basins used in the present invention) can be manufactured as an integral body for ensuring maximum structural integrity and minimum manufacturing cost. The material used may be plastic material or stainless steel.

Figure 16:
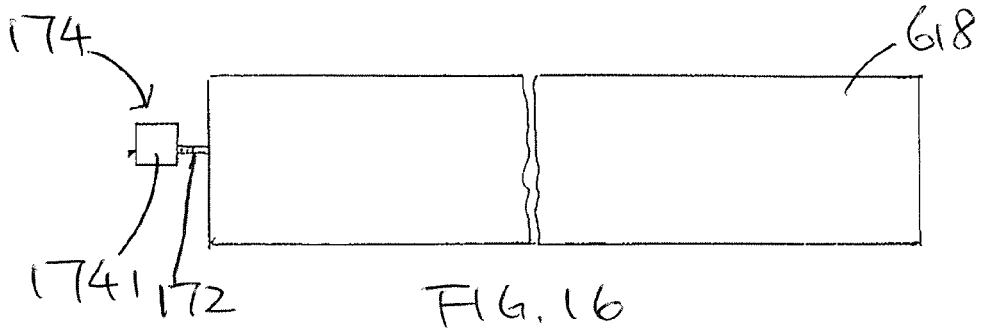
FIG. 16 is a schematic diagram of an automated control system of the flow control mechanism according to the preferred embodiment of the present invention.
Figure 17:
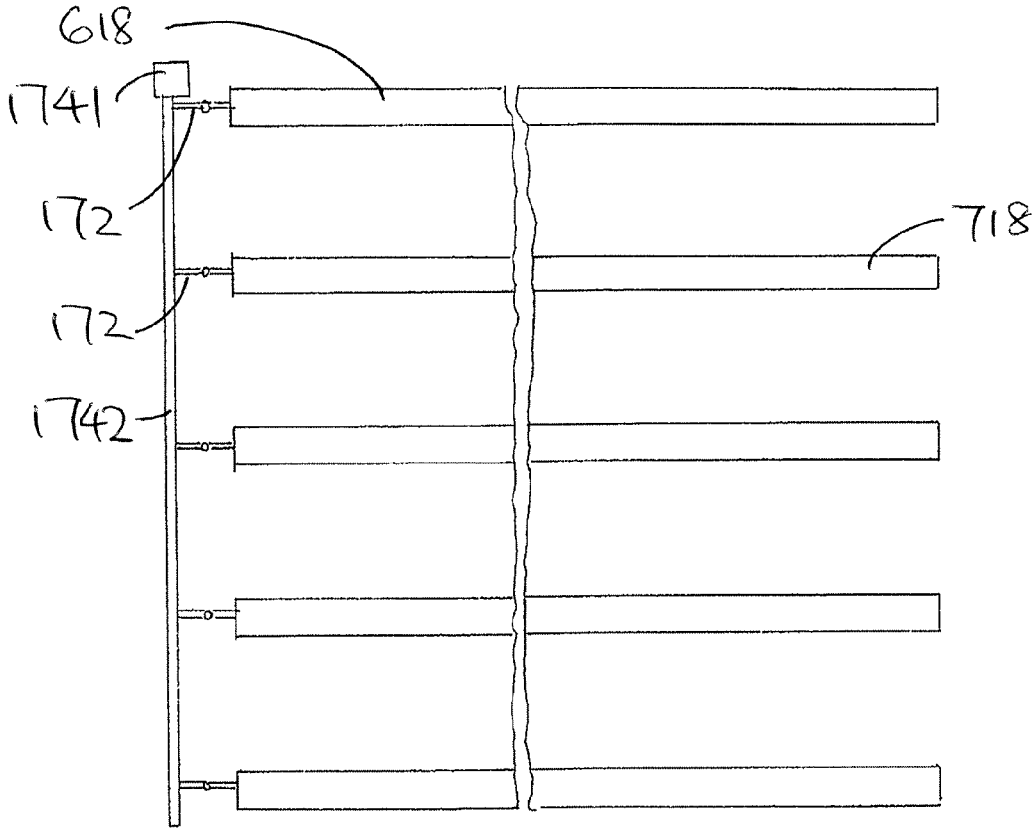
FIG. 17 is another schematic diagram of the automated control system of the flow control mechanism according to the preferred embodiment of the present invention.

Referring to FIG. 16 to FIG. 17 of the drawings, the flow control mechanism 17 further comprises an automated control system 174 operatively connected to at least one driving member 172. The automated control system 174 comprises a central control unit 1741, a connecting member 1742 connected between the central control unit 1741 and the driving member 172, and a sensor 1743 provided in the first water collection basin 61 and electrically connected to the central control unit 1741.

The sensor 1743 detects the water level in the first water collection basin 61 and sends a signal to the central control unit 1741, which is pre-programmed to respond to the sensor signal. The central control unit 1741 is then arranged to drive the connecting member 1742 to move horizontally so as to drive the driving member 172 to move in the same direction for controlling the flow rate of the cooling water flowing through the first passage plate 618.

Referring back to FIG. 9 of the drawings, the first cooling unit 6 further comprises a first water distributing panel 610 having a plurality of distribution openings 6101 mounted between the first water collection basin 61 and the first fill material unit 63 of the first cooling unit 6 for allowing the cooling water flowing from the first water collection basin 61 to be evenly distributed into the first fill material unit 63 along a transverse direction thereof. The purpose of the first water distributing panel 610 is to ensure proper formation of the water film in the first fill material unit 63 and optimal heat exchange performance between the water film and the ambient air.

Furthermore, each of the evaporative condensers 5 further comprises at least one filter member 15 supported between the first cooling unit 6 and the second cooling unit 7 for filtering unwanted substances from the cooling water flowing from the first cooling unit 6 to the second cooling unit 7, as shown in FIG. 10 of the drawings.

As shown in FIG. 10 of the drawings, the second water collection basin 71 has a second heat exchanging compartment 712, wherein the second heat exchanging pipes 72 are immersed in the second heat exchanging compartment 712. The cooling water coming from the first cooling unit 6 is guided to flow into the second heat exchanging compartment 712 via the filter member 15.

The second water collection basin 71 has a second inner sidewall 714, a second outer sidewall 715, and a second passage plate 718. The second heat exchanging compartment 712 is defined within the second inner sidewall 714, the second outer sidewall 715, and the second passage plate 718. The second passage plate 718 has a plurality of second passage holes 7181 for allowing the cooling water contained in the second heat exchanging compartment 712 to fall into the bottom water collection basin 100 or an additional cooling unit, such as the third cooling unit 8, when the multiple-effective evaporative condenser 5 has more than two cooling units. Referring to FIG. 12 of the drawings, the second passage holes 7181 are distributed along the second passage plate 718 in a predetermined array, wherein a center of each of the second passage holes 7181 in a particular row is arranged not to align with that of the second passage holes 7181 in the next row. Moreover, each two adjacent second passage holes 7181 of an upper row thereof is arranged to form a triangular distribution with a corresponding second passage hole 7181 of the adjacent row of the second passage holes 7181 as shown in FIG. 12 of the drawings. The second passage holes 7181 all have identical shape and size. These structures are identical to that of the first passage plate 618, and the first passage holes 6181.

In this preferred embodiment, the flow control mechanism 17 comprises a plurality of control plates 171 provided underneath the first passage plate 618 and the second passage plate 718, and a plurality of driving members 172 connected to the control plates 171 respectively for driving the control plates 171 to move in a horizontal and reciprocal manner respectively, as shown in FIG. 9 and FIG. 10 of the drawings. Generally speaking, the flow control mechanism 17 comprises the same number of control plates 171 as that of the cooling units 6, 7, 8, 9, 10. In other words, when the multiple-effective evaporative condensers 5 comprises first through fifth cooling units 6, 7, 8, 9, 10, the flow control mechanism will comprise five control plates 171 and five driving members 172. The structure of each of the control plates 171 and the driving members 172 is identical and has been described above. This structure is illustrated in FIG. 17 of the drawings.

Referring to FIG. 15 of the drawings, the second water collection basin 71 further has a pair of second securing slots 719 formed at lower portions of the second inner side wall 714 and the second outer sidewall 715 respectively. Each of the second securing slots 719 is elongated along a longitudinal direction of the second water collection basin 71, wherein the corresponding securing members 173 are mounted in the second securing slots 719 respectively. Again, in this preferred embodiment, each of the securing members 173 is a resilient element which normally exert an upward biasing force against the corresponding control plate 171.

As mentioned above and as shown in FIG. 16 to FIG. 17 of the drawings, the flow control mechanism 17 may be operated through the automated control system 174 operatively connected to all the driving members 172 for electrically and automatically controlling the movement of all of the driving members and ultimately the control plates 171.

Referring back to FIG. 10 of the drawings, the second cooling unit 7 further comprises a second water distributing panel 710 having a plurality of distribution openings 7101 mounted between the second water collection basin 71 and the second fill material unit 73 of the second cooling unit 7 for allowing the cooling water flowing from the second water collection basin 71 to be evenly distributed into the second fill material unit 73 along a transverse direction thereof. The purpose of the second water distributing panel 710 is to ensure proper formation of the water film in the second fill material unit 73 and optimal heat exchange performance between the water film and the ambient air.

Furthermore, each of the evaporative condensers 5 further comprises a plurality of filter members 15 supported between each two cooling units for filtering unwanted substances from the cooling water flowing from an upper cooling unit to an immediately lower cooling unit.

Figure 18:
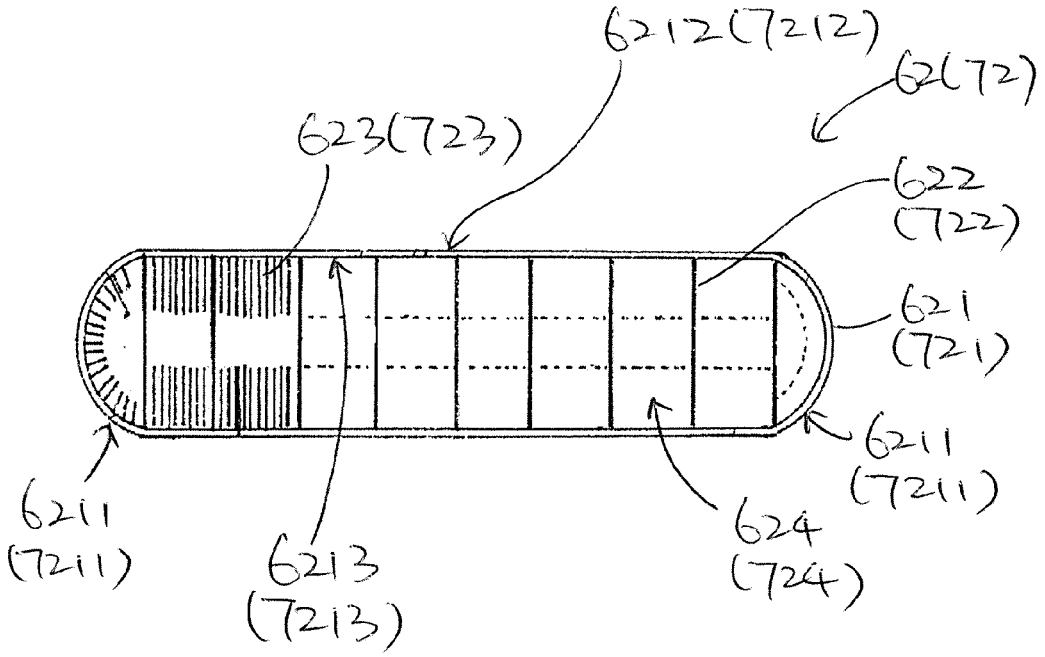
FIG. 18 is a sectional side view of a heat exchanging pipe of the multiple-effective evaporative condenser according to a preferred embodiment of the present invention.

Referring to FIG. 18 of the drawings, each of the first heat exchanging pipes 62 comprises a first pipe body 621 and a plurality of first retention members 622 spacedly formed in the first pipe body 621, and a plurality of first heat exchanging fins 623 extended from an inner surface 6213 of the pipe body 621. Specifically, the first pipe body 621 has two curved side portions 6211 and a substantially flat mid portion 6212 extending between the two curved side portions to form rectangular cross sectional shape at the mid portion 6212 and two semicircular cross sectional shapes at two curved side portions 621 of the first heat exchanging pipe 62.

Furthermore, the retention members 622 are spacedly distributed in the flat mid portion 6212 along a transverse direction of the corresponding pipe body 621 so as to form a plurality of first pipe cavities 624. Each of the retention members 622 has a predetermined elasticity for reinforcing the structural integrity of the corresponding first heat exchanging pipe 62. On the other hand, each of the first heat exchanging fins 623 are extended from an inner surface of the first pipe body 621. The first heat exchanging fins 623 are spacedly and evenly distributed along the inner surface 6213 of first pipe body 621 for enhancing heat exchange performance between the refrigerant flowing through the corresponding first heat exchanging pipe 62 and the cooling water.

When the first heat exchanging pipes 62 operate under vacuum condition, or when the first heat exchanging pipes 62 are subject to higher external pressure (meaning negative pressure inside the pipes 62), the first heat exchanging fins 623 may be used to withstand a certain amount of external pressure so as to reinforcing the structural integrity of the first heat exchanging pipes 62. The length of the first heat exchanging fins 623 depend on the actual circumstances in which the first heat exchanging pipes 62 are used.

On the other hand, when the first heat exchanging pipes 62 are subject to positive pressure inside the pipes 62 (such as for a typical air conditioning system), the first retention members 622, having a predetermined elasticity, will exert a pulling force to the first pipe body 621 and therefore may assist in withstanding such positive pressure developed inside the first pipe body 621.

On the other hand, the second heat exchanging pipes 72 are structurally identical to the first heat exchanging pipes 62. So, also referring to FIG. 18 of the drawings, each of the second heat exchanging pipes 72 comprises a second pipe body 721 and a plurality of second retention members 722 spacedly formed in the second pipe body 721, and a plurality of second heat exchanging fins 723 extended from an inner surface 7213 of the pipe body 721. Specifically, the second pipe body 721 has two curved side portions 7211 and a substantially flat mid portion 7212 extending between the two curved side portions to form rectangular cross sectional shape at the mid portion 7212 and two semicircular cross sectional shapes at two curved side portions 721 of the second heat exchanging pipe 72.

Furthermore, the retention members 722 are spacedly distributed in the flat mid portion 7212 along a transverse direction of the corresponding pipe body 721 so as to form a plurality of second pipe cavities 724. Each of the retention members 722 has a predetermined elasticity for reinforcing the structural integrity of the corresponding second heat exchanging pipe 72. On the other hand, each of the second heat exchanging fins 723 are extended from an inner surface of the second pipe body 721. The second heat exchanging fins 723 are spacedly and evenly distributed along the inner surface 7213 of second pipe body 721 for enhancing heat exchange performance between the refrigerant flowing through the corresponding second heat exchanging pipe 72 and the cooling water.

It is worth mentioning that when the multiple-effect evaporative condenser 5 comprises many cooling units, such as the above-mentioned first through fifth cooling units 6, 7, 8, 9, 10, the third through fifth heat exchanging pipes 82, 92, 102 are structurally identical to the first heat exchanging pipes 62 and the second heat exchanging pipes 72 described above.

According to the preferred embodiment of the present invention, each of the first through fifth heat exchanging pipes 62, 72, 82, 92, 102 are configured from aluminum which can be recycled and reused very conveniently and economically. In order to make the heat exchanging pipes to resist corrosion and unwanted oxidation, each of the heat exchanging pipes 62, 72, 82, 92, 102 has a thin oxidation layer formed on an exterior surface and an interior surface thereof for preventing further corrosion of the relevant heat exchanging pipe. The formation of this thin oxidation layer can be by anode oxidation method.

Moreover, each of the heat exchanging pipes 62, 72, 82, 92, 102 may also have a thin layer of polytetrafluoroethylene formed on an exterior surface thereof to prevent unwanted substances from attaching on the exterior surfaces of the heat exchanging pipes 62, 72, 82, 92, 102.

The use of aluminum for the heat exchanging pipes 62, 72, 82, 92, 102 allows reduction of manufacturing cost by approximately 50% as compared with traditional heat exchanging pipes, which are configured from copper. Possible corrosion problem is effectively resolved by the introduction of the thin oxidation layer on an exterior surface and an interior surface of each of the heat exchanging pipes 62 (72) (82) (92) (102) and the addition of the thin layer of thin layer of polytetrafluoroethylene on the exterior surfaces of the heat exchanging pipes 62 (72) (82) (92) (102).

It can be appreciated that when the use of the multiple-effect evaporative condensers 5, the entire air conditioning system will become extremely compact. The outer housing 30 and all other components can be put on top of a building. Unlike traditional air conditioning systems which utilize some sorts of cooling towers, the present invention does not require users to install any other components or designate any areas in the building for accommodating other components.

Figure 19:
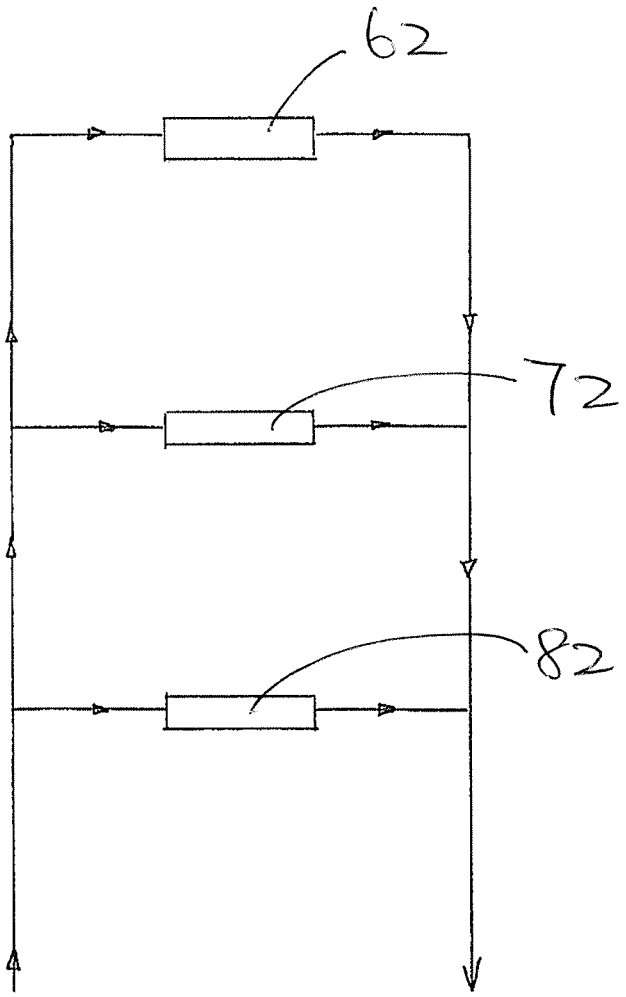
FIG. 19 is a schematic diagram of a flowing route of the refrigerant flowing through a multiple-effective evaporative condenser according to a preferred embodiment of the present invention.

Referring to FIG. 19 of the drawings, it illustrates that the first heat exchanging pipes 62, the second heat exchanging pipes 72 and the third heat exchanging pipes 82 are connected in parallel. As a result, the refrigerant enters the relevant multiple-effect evaporative condenser 5 and passes through the first through third heat exchanging pipes 62, 72, 82 at the same time. After passing through each of the first through third heat exchanging pipes 62, 72, 82, the temperature of the refrigerant will be lowered and the refrigerant is arranged to exit the multiple-effect evaporative condenser 5.

Figure 20:
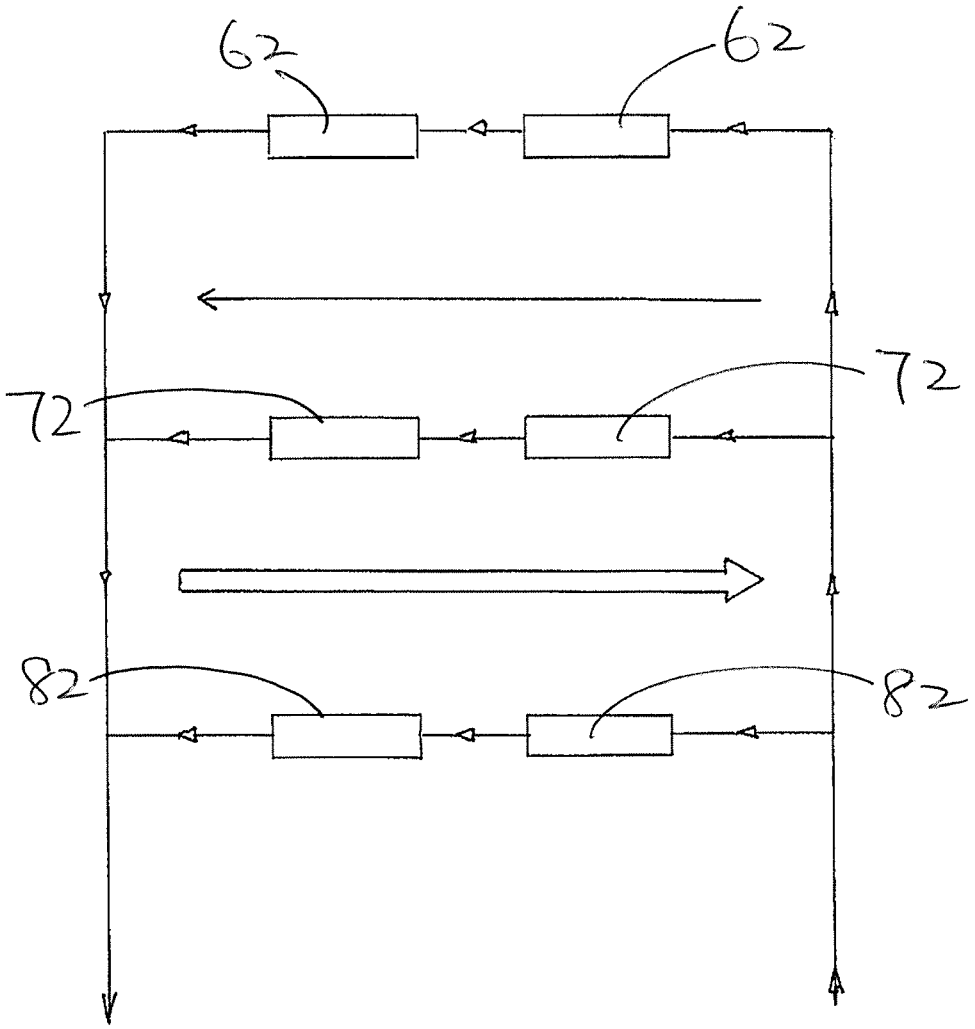
FIG. 20 is another schematic diagram of a flowing route of the refrigerant flowing through a multiple-effective evaporative condenser according to a preferred embodiment of the present invention.

Referring to FIG. 8 and FIG. 20 of the drawings, two of the multiple-effect evaporative condensers 5 may form an evaporative condenser group for cooling the refrigerant. For example, two multiple-effect evaporative condensers 5 may be placed side-by-side in which the air outlet side 52 of one multiple-effective evaporative condenser 5 faces the air inlet side 51 of another multiple-effect evaporative condenser 5. Moreover, the refrigerant flowing through the first heat exchanging pipes 62 of one multiple-effect evaporative condenser 5 is arranged to flow into the first heat exchanging pipes 62 of another multiple-effect evaporative condenser 5. Likewise, the refrigerant flowing through the second heat exchanging pipes 72 of one multiple-effect evaporative condenser 5 is arranged to flow into the second heat exchanging pipes 72 of another multiple-effect evaporative condenser 5. The refrigerant flowing through the third heat exchanging pipes 82 of one multiple-effect evaporative condenser 5 is arranged to flow into the third heat exchanging pipes 82 of another multiple-effect evaporative condenser 5.

In the arrangement illustrated in FIG. 20, ambient air should be drawn in the direction which is opposite to the flow of the refrigerant. For example, if the refrigerant is flowing from the first multiple-effect evaporative condenser 5 to a second multiple-effect evaporative condenser 5, the ambient air should be drawn from the second multiple-effect evaporative condenser 5 to the first multiple-effect evaporative condenser 5.

Figure 21:
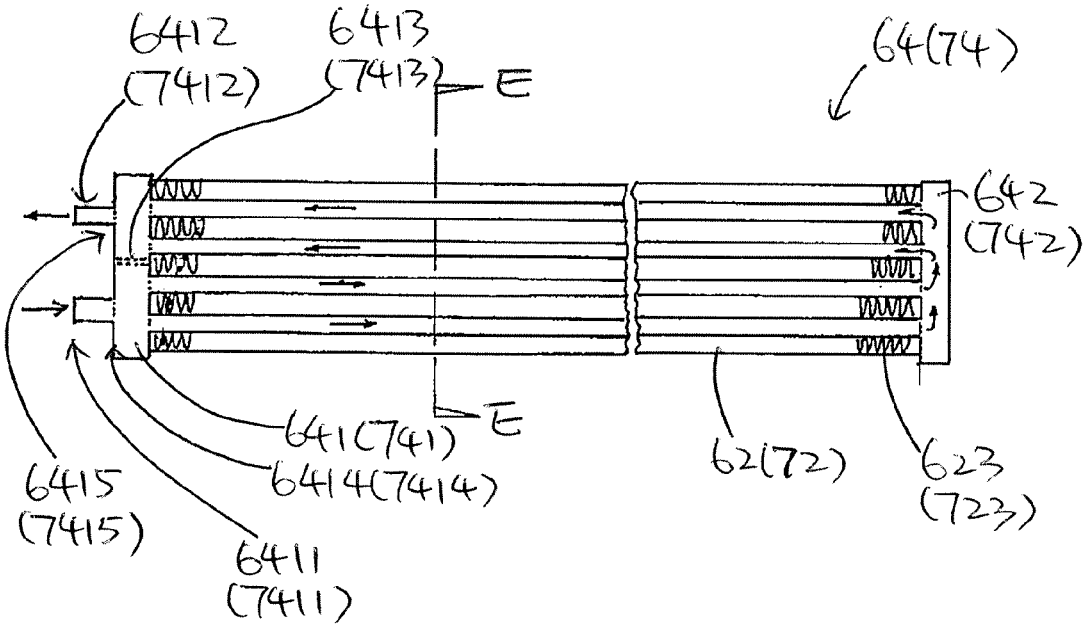
FIG. 21 is a schematic diagram of the first heat exchanging pips of the first cooling unit according to the preferred embodiment of the present invention.
Figure 22:
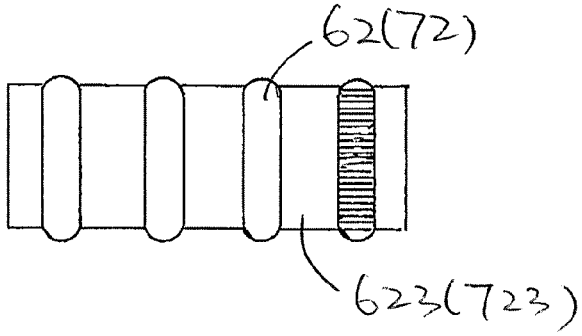
FIG. 22 is a sectional side view along plane E-E of FIG. 21.

Referring to FIG. 21 to FIG. 22 of the drawings, the first cooling unit 6 further comprises a first guiding system 64 connected to the first heat exchanging pipes 62 to divide the first heat exchanging pipes 62 into several piping groups so as to guide the refrigerant to flow through the various piping groups in a predetermined order. Specifically, the first guiding system 64 comprises a first inlet collection pipe 641 and a first guiding pipe 642, wherein each of the first heat exchanging pipes 62 has one end connected to first inlet collection pipe 641, and another end connected to the first guiding pipe 642. As shown in FIG. 21 of the drawings, the first inlet collection pipe 641 has a first fluid inlet 6411, a first fluid outlet 6412, and a divider 6413 provided in the first inlet collection pipe 641 to divide the first inlet collection pipe 641 into an inlet portion 6414 and an outlet portion 6415. The divider 6413 prevents fluid from passing from one side of the divider 6413 to the other side of the divider 6413 (i.e. the fluid is prevented from passing from the first inlet portion 6414 to the first outlet portion 6415). The first fluid inlet 6411 is formed on the first inlet portion 6414, while the first fluid outlet 6412 is formed on the first outlet portion 6415.

According to the preferred embodiment of the present invention, there are altogether four first heat exchanging pipes 62 which are divided into two piping groups. The refrigerant enters the first inlet collection pipe 641 through the first fluid inlet 6411. The first piping group has two first heat exchanging pipes 62 which are connected to the first inlet portion 6414 while the second piping group has another two of the first heat exchanging pipes 62 which are connected to the first outlet portion 6415. Thus, the refrigerant entering the first inlet collection pipe 641 is guided to flow through the two heat exchanging pipes 62 of the first piping group. The refrigerant then leaves the two corresponding first heat exchanging pipes 62 and enters the first guiding pipe 642. The refrigerant flowing in the first guiding pipe 642 is allowed to enter the other two first heat exchanging pipes 62 of the second piping group. The refrigerant is then guided to flow through the two first heat exchanging pipes 62 of the second piping group. The refrigerant then exits the first inlet collection pipe 641 through the first fluid outlet 6412. The refrigerant flowing through the first heat exchanging pipes 62 are arranged to perform heat exchange with the cooling water passing through the first cooling unit 6.

In addition, the first guiding system 64 further comprises a plurality of first heat exchanging fins 623 extended between each two adjacent first heat exchanging pipes 62 for substantially increasing a surface area of heat exchange between the first heat exchanging pipes 62 and the cooling water, and for reinforcing a structural integrity of the first guiding system 64. These first heat exchanging fins 623 may be integrally extended from an outer surface of the first heat exchanging pipes 62, or externally attached or welded on the outer surfaces of the first heat exchanging pipes 62.

The second cooling unit 7 further comprises a second guiding system 74 connected to the second heat exchanging pipes 72 to divide the second heat exchanging pipes 72 into a predetermined number of piping groups, and for guiding the refrigerant to flow through the second heat exchanging pipes 72 in a predetermined order. The structure of the second guiding system 74 is identical to that of the first guiding system 64. Thus, the second guiding system 74 comprises a second inlet collection pipe 741 and a second guiding pipe 742, wherein each of the second heat exchanging pipes 72 has one end connected to second inlet collection pipe 741, and another end connected to the second guiding pipe 742. As shown in FIG. 21 of the drawings, the second inlet collection pipe 741 has a second fluid inlet 7411, a second fluid outlet 7412, and a second divider 7413 provided in the second inlet collection pipe 741 to divide the second inlet collection pipe 741 into an inlet portion 7414 and an outlet portion 7415. The second divider 7413 prevents fluid from passing from one side of the second divider 7413 to the other side of the second divider 7413 (i.e. the fluid is prevented from passing from the second inlet portion 7414 to the second outlet portion 7415). The second fluid inlet 7411 is formed on the second inlet portion 7414, while the second fluid outlet 7412 is formed on the second outlet portion 7415.

Again, there are altogether four second heat exchanging pipes 72 which are divided into two piping groups. The refrigerant enters the second inlet collection pipe 741 through the second fluid inlet 7411. The first piping group has two of the second heat exchanging pipes 72 which are connected to the second inlet portion 7414 while another piping group has the remaining two of the second heat exchanging pipes 72 which are connected to the second outlet portion 7415. Thus, the refrigerant entering the second inlet collection pipe 741 is guided to flow through the two heat exchanging pipes 72 which are connected to the second inlet portion 7414 (i.e. the first piping group). The refrigerant then leaves the two second heat exchanging pipes 72 and enters the second guiding pipe 742. The refrigerant flowing in the second guiding pipe 742 is allowed to enter the other two second heat exchanging pipes 72 which are connected to the second outlet portion 7415 (i.e. the second piping group). The refrigerant is then guided to flow through the two second heat exchanging pipes 72 which are connected to the second outlet portion 7415 and enters it. The refrigerant then exits the second inlet collection pipe 741 through the second fluid outlet 7412. The refrigerant flowing through the second heat exchanging pipes 72 are arranged to perform heat exchange with the cooling water passing through the second cooling unit 7.

In addition, the second guiding system 74 further comprises a plurality of second heat exchanging fins 723 extended between each two adjacent second heat exchanging pipes 72 for substantially increasing a surface area of heat exchange between the second heat exchanging pipes 72 and the cooling water, and for reinforcing a structural integrity of the second guiding system 74. These second heat exchanging fins 723 may be integrally extended from an outer surface of the second heat exchanging pipes 72, or externally attached or welded on the outer surfaces of the second heat exchanging pipes 72.

It is important to mention at this stage that the above-mentioned configuration of the first guiding system 64, the second guiding system 74, the first heat exchanging pipes 62, the second heat exchanging pipes 72, and the number of piping groups are for illustrative purpose only and can actually be varied according to the circumstances in which the present invention is operated.

Figure 23:
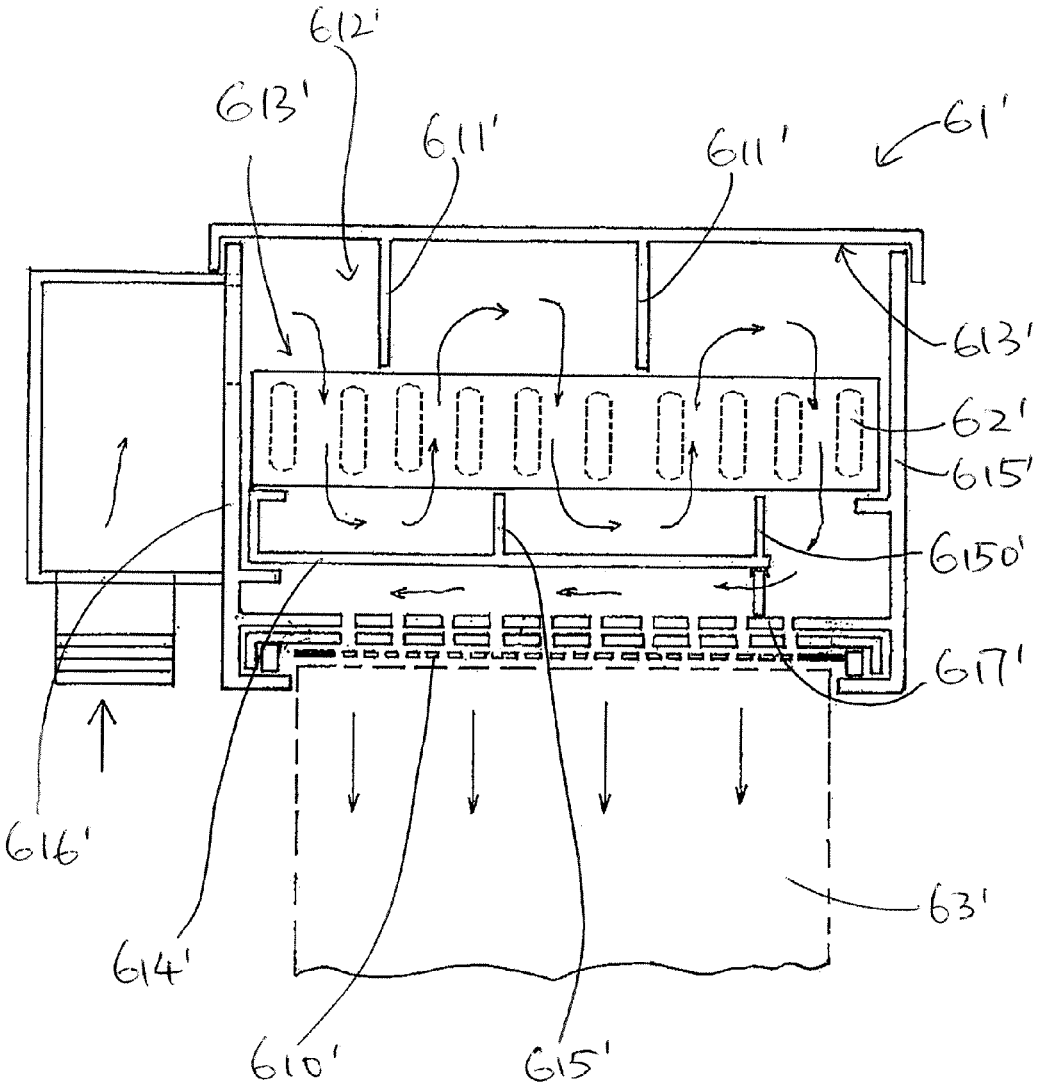
FIG. 23 is a side view of a first alternative mode of the first water collection basin according to the preferred embodiment of the present invention.

Referring to FIG. 23 of the drawings, an alternative mode of the air conditioning system according to the preferred embodiment of the present invention is illustrated. The alternative mode is identical to the preferred embodiment as described above except the first water collection basin 61' and the second water collection basin 71'. According to the alternative mode, the first water collection basin 61' further comprises a supporting member 614' securely mounted at a lower portion thereof, a plurality of top separating panels 611' spacedly extended from a top ceiling 613' of the first water collection basin 61', and a plurality of bottom separating panels 6150' spacedly and upwardly extended from the supporting member 614' to divide the first heat exchanging compartment 612' into a plurality of heat exchanging chambers 613'.

As shown in FIG. 23 of the drawings, the piping groups of the first heat exchanging pipes 62 are received in the heat exchanging chambers 613' respectively. The first (leftmost) heat exchanging chamber 613' is formed between the first partitioning wall 616' and the leftmost top separating panel 611'. The second heat exchanging chamber 613' is formed between the leftmost separating panel 611' and the adjacent bottom separating panel 6150' which is extended from the supporting member 614'. The next heat exchanging chamber 613' is formed between the bottom separating panel 6150' and the next top separating panel 611'. The next heat exchanging chamber 613' is formed between the top separating panel 611' and the next bottom separating panel 6150'. The last heat exchanging chamber 613' is formed between the bottom separating panel 6150' and an outer sidewall of the first water collection basin 61'.

In other words, apart from the two side heat exchanging chambers 613' (i.e. the leftmost heat exchanging chamber 613' and the rightmost heat exchanging chamber 613'), each of the remaining heat exchanging chambers 613' is defined by one top separating panel 6150' and an adjacent bottom separating panel 6150', wherein each of the piping groups is received in one of the heat exchanging chambers 613'.

As a result, the cooling water entering the first heat exchanging compartment 612' via the first water channel 613 is forced or guided to flow through each of the heat exchanging chambers 613' and the corresponding heat exchanging pipes 62 of the corresponding piping group. It is worth mentioning that a length of the supporting member 614' is less than that of the heat exchanging compartment 612' so that the rightmost heat exchanging chamber 613' is formed between the rightmost bottom separating panel 6150' and the first outer sidewall 615'. After passing through the last heat exchanging chamber 613', the cooling water is then guided to flow through the first bottom plate 617' and the first water distributing panel 610'. The temperature of the cooling water leaving the heat exchanging compartment 612' is increased to a predetermined amount so as to maximize the heat exchanging efficiency between the cooling water and the ambient air in the first fill material unit 63'.

Note that a space between each two top separating panels 611' and each two bottom separating panels 6150' may be varied so that the number of the first heat exchanging pipes 62 that can be accommodated in each heat exchanging chamber 613' can also be varied.

Figure 24:
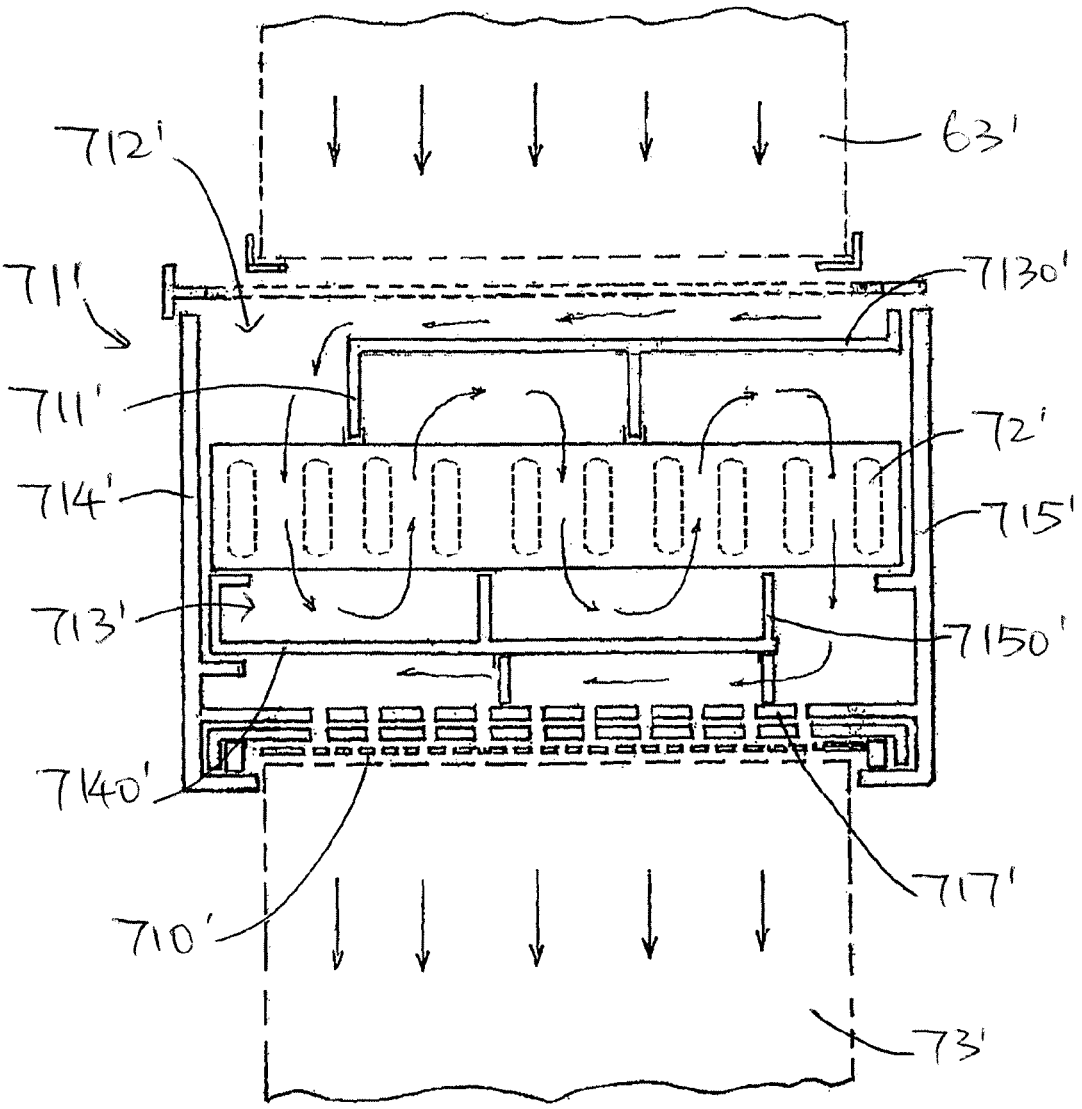
FIG. 24 is a side view of a first alternative mode of the second water collection basin according to the preferred embodiment of the present invention.

Referring to FIG. 24 of the drawings, the second water collection basin 71' according to the alternative mode of the air conditioning system is illustrated. Like the first water collection basin 61' as described above, the second water collection basin 71' further comprises a supporting member 7140' securely mounted at a lower portion thereof, a plurality of top separating panels 711' spacedly extended from a top ceiling 7130' of the second water collection basin 71', and a plurality of bottom separating panels 7150' spacedly and upwardly extended from the supporting member 7140' to divide the second heat exchanging compartment 712' into a plurality of heat exchanging chambers 713'.

As shown in FIG. 24 of the drawings, the piping groups of the second heat exchanging pipes 72 are received in the heat exchanging chambers 713' respectively. The leftmost heat exchanging chamber 713' is formed between the inner sidewall 714' and the leftmost top separating panel 711'. The second heat exchanging chamber 713' is formed between the leftmost separating panel 711' and the adjacent bottom separating panel 7150' which is extended from the supporting member 7140'. The next heat exchanging chamber 713' is formed between the bottom separating panel 7150' and the next top separating panel 711'. The next heat exchanging chamber 713' is formed between the top separating panel 711' and the next bottom separating panel 7150'. The last heat exchanging chamber 713' is formed between the bottom separating panel 7150' and an outer sidewall 715' of the second water collection basin 71'.

In other words, apart from the two side heat exchanging chambers 713' (i.e. the leftmost heat exchanging chamber 713' and the rightmost heat exchanging chamber 713'), each of the remaining heat exchanging chambers 713' is defined by one top separating panel 715' and an adjacent bottom separating panel 715', wherein each of the piping groups of the second heat exchanging pipes 72 is received in one of the heat exchanging chambers 713'.

As a result, the cooling water entering the second heat exchanging compartment 712' via the second water channel 713 is forced or guided to flow through each of the heat exchanging chambers 713' and the corresponding second heat exchanging pipes 72. It is worth mentioning that a length of the supporting member 7140' is less than that of the heat exchanging compartment 712' so that the rightmost heat exchanging chamber 713' is formed between the rightmost bottom separating panel 7150' and the second outer sidewall 715'. After passing through the last heat exchanging chamber 713', the cooling water is then guided to flow through the second bottom plate 717' and the second water distributing panel 710'. The temperature of the cooling water leaving the heat exchanging compartment 712' is increased to a predetermined amount so as to maximize the heat exchanging efficiency between the cooling water and the ambient air in the second fill material unit 73'.

Figure 25:
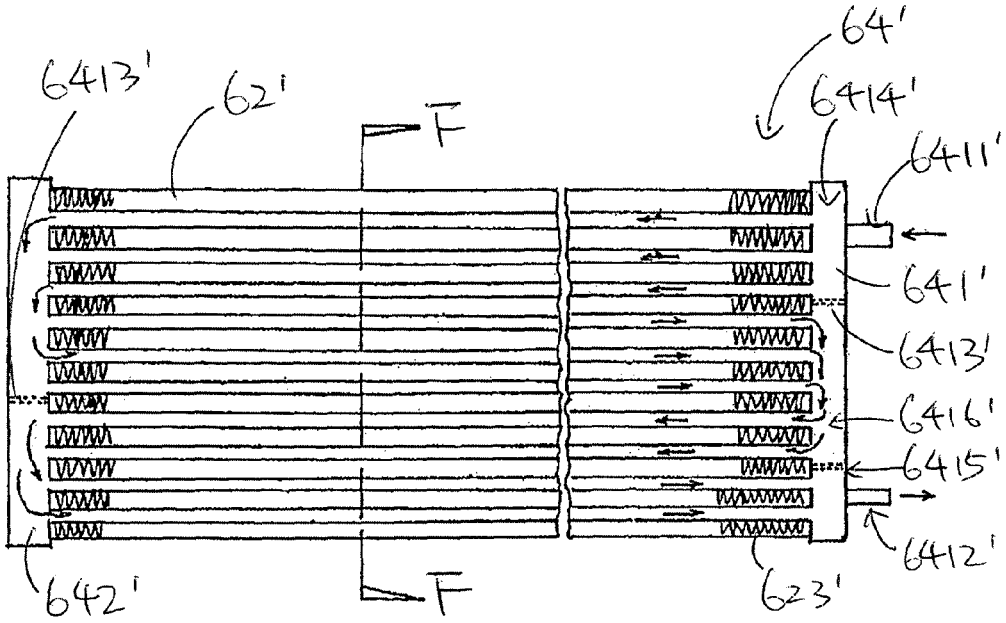
FIG. 25 is a schematic diagram of the first heat exchanging pips of the first cooling unit according to the alternative mode of the preferred embodiment of the present invention.
Figure 26:
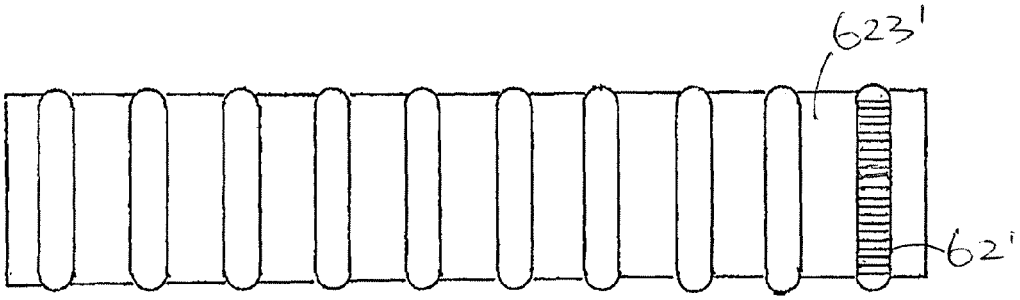
FIG. 26 is a sectional side view along plane F-F of FIG. 25.

Referring to FIG. 25 to FIG. 26 of the drawings, according to the alternative mode of the present invention, the first cooling unit 6' further comprises a first guiding system 64' connected to the first heat exchanging pipes 62' for guiding the refrigerant to flow through the first heat exchanging pipes 62' in a predetermined order. Specifically, the first guiding system 64' comprises a first inlet collection pipe 641' and a first guiding pipe 642', wherein each of the first heat exchanging pipes 62' has one end connected to first inlet collection pipe 641', and another end connected to the first guiding pipe 642'.

As shown in FIG. 25 of the drawings, the first inlet collection pipe 641' has a first fluid inlet 6411', a first fluid outlet 6412', and a plurality of dividers 6413' provided in the first inlet collection pipe 641' to divide the first heat exchanging pipes 62' into a plurality of piping groups. The dividers 6413' in the first inlet collection pipe 641' divides it into an inlet portion 6414', an outlet portion 6415', and one intermediate portion 6416'. Each divider 6413' prevents fluid from passing from one side of the divider 6413' to the other side of the corresponding divider 6413'. The first fluid inlet 6411' is formed on the first inlet portion 6414', while the first fluid outlet 6412' is formed on the first outlet portion 6415'. One divider 6413' is also provided in the first guiding pipe 642' to evenly divide the first guiding pipe 642' into two portions.

In this alternative mode, there are altogether ten first heat exchanging pipes 62' which are divided into four piping groups. The first piping group us constituted by three first heat exchanging pipes 62'. The second piping group is constituted by the next three first heat exchanging pipes 62'. The third piping group is constituted by the next two first heat exchanging pipes 62'. The last piping group is constituted by the final two first heat exchanging pipes 62'. The refrigerant enters the first inlet collection pipe 641' through the first fluid inlet 6411'. Three of the first heat exchanging pipes 62' (the first piping group) are connected to the first inlet portion 6414', while five of the first heat exchanging pipes 62 are connected to the intermediate portion 6416' (the second and the third piping group). The remaining two first heat exchanging pipes 62' (the fourth piping group) are connected to the first outlet portions 6415'. The refrigerant entering the first inlet collection pipe 641' is guided to flow through the three heat exchanging pipes 62' (the first piping group) which are connected to the first inlet portion 6414'. The refrigerant then leaves the three first heat exchanging pipes 62' and enters the first guiding pipe 642'. The refrigerant flowing in the first guiding pipe 642' is guided by the divider 6413' in the first guiding pipe 642' to enter three subsequent first heat exchanging pipes 62' (the second piping group) which are connected to the intermediate outlet portion 6415'. The refrigerant re-enters the first inlet collection pipe 641' and is then guided to flow through the next two first heat exchanging pipes 62' which are connected to the intermediate portion 6416' (the third piping group). The refrigerant re-enters the first guiding pipe 642' and is then guided to flow through the final two of the first heat exchanging pipes 62' which are connected to the first outlet portion 6415' (the fourth piping group). The refrigerant then exits the first inlet collection pipe 641' through the first fluid outlet 6412'. As in the preferred embodiment described above, the refrigerant flowing through the first heat exchanging pipes 62' are arranged to perform heat exchange with the cooling water passing through the first cooling unit 6.

As shown in FIG. 26 of the drawings, the first guiding system 64' further comprises a plurality of first heat exchanging fins 623' extended between each two adjacent first heat exchanging pipes 62' for substantially increasing a surface area of heat exchange between the first heat exchanging pipes 62' and the cooling water, and for reinforcing a structural integrity of the first guiding system 64'. These first heat exchanging fins 623' may be integrally extended from an outer surface of the first heat exchanging pipes 62', or externally attached or welded on the outer surfaces of the first heat exchanging pipes 62'.

Figure 27:
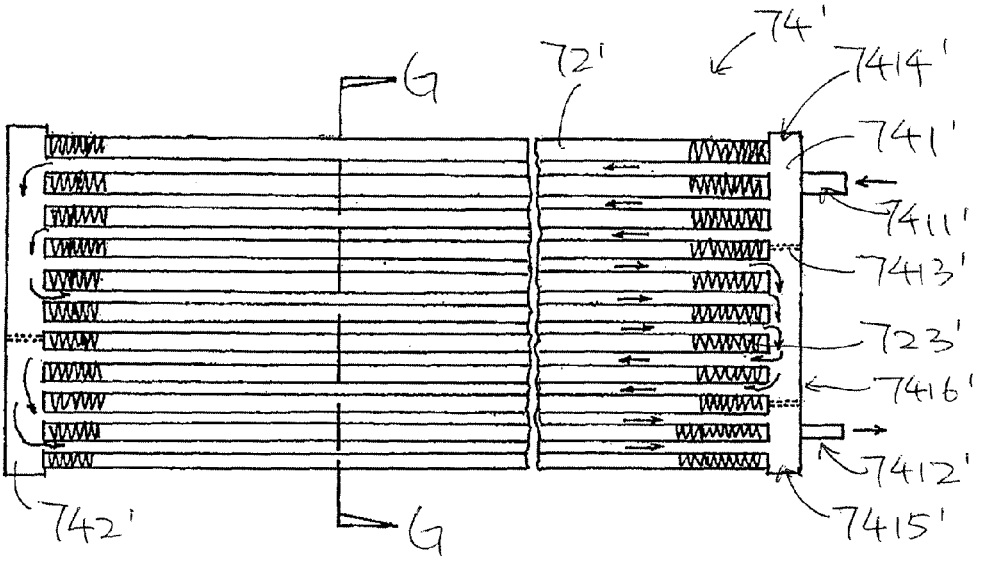
FIG. 27 is a schematic diagram of the second heat exchanging pips of the second cooling unit according to the alternative mode of the preferred embodiment of the present invention.
Figure 28:
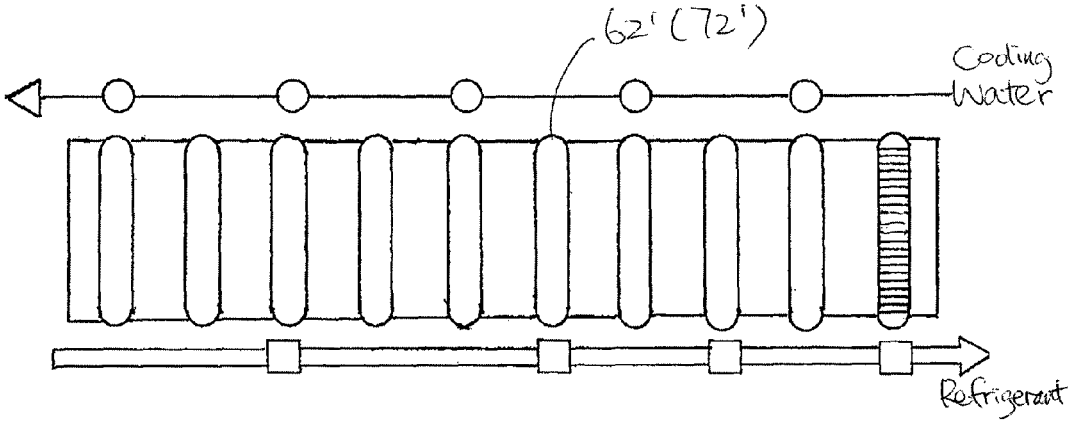
FIG. 28 is a sectional side view along plane G-G of FIG. 27.

Referring to FIG. 27 to FIG. 28 of the drawings, according to the alternative mode of the present invention, the second cooling unit 7 further comprises a second guiding system 74' connected to the second heat exchanging pipes 72' for guiding the refrigerant to flow through the second heat exchanging pipes 72' in a predetermined order. Specifically, the second guiding system 74' comprises a second inlet collection pipe 741' and a second guiding pipe 742', wherein each of the second heat exchanging pipes 72' has one end connected to second inlet collection pipe 741', and another end connected to the second guiding pipe 742'.

As shown in FIG. 27 of the drawings, the second inlet collection pipe 741' has a second fluid inlet 7411', a second fluid outlet 7412', and a plurality of dividers 7413' provided in the second inlet collection pipe 741' and the second guiding pipe 742' to divide the second heat exchanging pipes 72' into a plurality of piping groups. The dividers 7413' in the second inlet collection pipe 741' divides the second inlet collection pipe 741' into an inlet portion 7414', an outlet portion 7415', and one intermediate portion 7416'. Each dividers 7413' prevents fluid from passing from one side of the divider 7413' to the other side of the corresponding divider 7413'. The second fluid inlet 7411' is formed on the second inlet portion 7414', while the second fluid outlet 7412' is formed on the second outlet portion 7415'. One divider 7413' is also provided in the second guiding pipe 742' to evenly divide the second guiding pipe 742' into two portions.

In this alternative mode, there are altogether ten second heat exchanging pipes 72' which are divided into four piping groups. The second piping group is constituted by three second heat exchanging pipes 72'. The second piping group is constituted by the next three second heat exchanging pipes 72'. The third piping group is constituted by the next two second heat exchanging pipes 72'. The last piping group is constituted by the final two second heat exchanging pipes 72'. The refrigerant enters the second inlet collection pipe 741' through the second fluid inlet 7411'. Three of the second heat exchanging pipes 72' (the first piping group) are connected to the second inlet portion 7414', while five of the second heat exchanging pipes 72' are connected to the intermediate portion 7416' (the second and the third piping group). The remaining two second heat exchanging pipes 72' (the fourth piping group) are connected to the second outlet portions 7415'. The refrigerant entering the second inlet collection pipe 741' is guided to flow through the three heat exchanging pipes 72' (the first piping group) which are connected to the second inlet portion 7414'. The refrigerant then leaves the three second heat exchanging pipes 72' and enters the second guiding pipe 742'. The refrigerant flowing in the second guiding pipe 742' is guided by the corresponding divider 7413' in the second guiding pipe 742' to enter three subsequent second heat exchanging pipes 72' (the second piping group) which are connected to the intermediate outlet portion 7415'. The refrigerant re-enters the second inlet collection pipe 741' and is then guided to flow through the next two second heat exchanging pipes 72' which are connected to the intermediate portion 7416' (the third piping group). The refrigerant re-enters the second guiding pipe 742' and is then guided to flow through the final two of the second heat exchanging pipes 72' which are connected to the second outlet portion 7415' (the fourth piping group). The refrigerant then exits the second inlet collection pipe 741' through the second fluid outlet 7412'. As in the preferred embodiment described above, the refrigerant flowing through the second heat exchanging pipes 72' are arranged to perform heat exchange with the cooling water passing through the second cooling unit 7.

As shown in FIG. 27 of the drawings, the second guiding system 74' further comprises a plurality of second heat exchanging fins 723' extended between each two adjacent second heat exchanging pipes 72' for substantially increasing a surface area of heat exchange between the second heat exchanging pipes 72' and the cooling water, and for reinforcing a structural integrity of the second guiding system 74'. These second heat exchanging fins 723' may be integrally extended from an outer surface of the second heat exchanging pipes 72', or externally attached or welded on the outer surfaces of the second heat exchanging pipes 72'.

In the alternative mode, for both the first cooling unit 6 and the second cooling unit 7, the number of dividers 6413', 7413' may be varied so as to direct the flow of the refrigerant through the first heat exchanging pipes 62' and the second heat exchanging pipes 72' in any predetermined manner.

Referring to FIG. 28 of the drawings, for each of the cooling units, the cooling water is guided to flow from the fourth piping group to the first piping group while the refrigerant is flowing from the first piping group to the fourth piping group. This arrangement ensures maximum heat exchange efficiency between the refrigerant and the cooling water. The first through fourth piping groups may accommodate in the fourth through first heat exchanging chambers.

Figure 29:
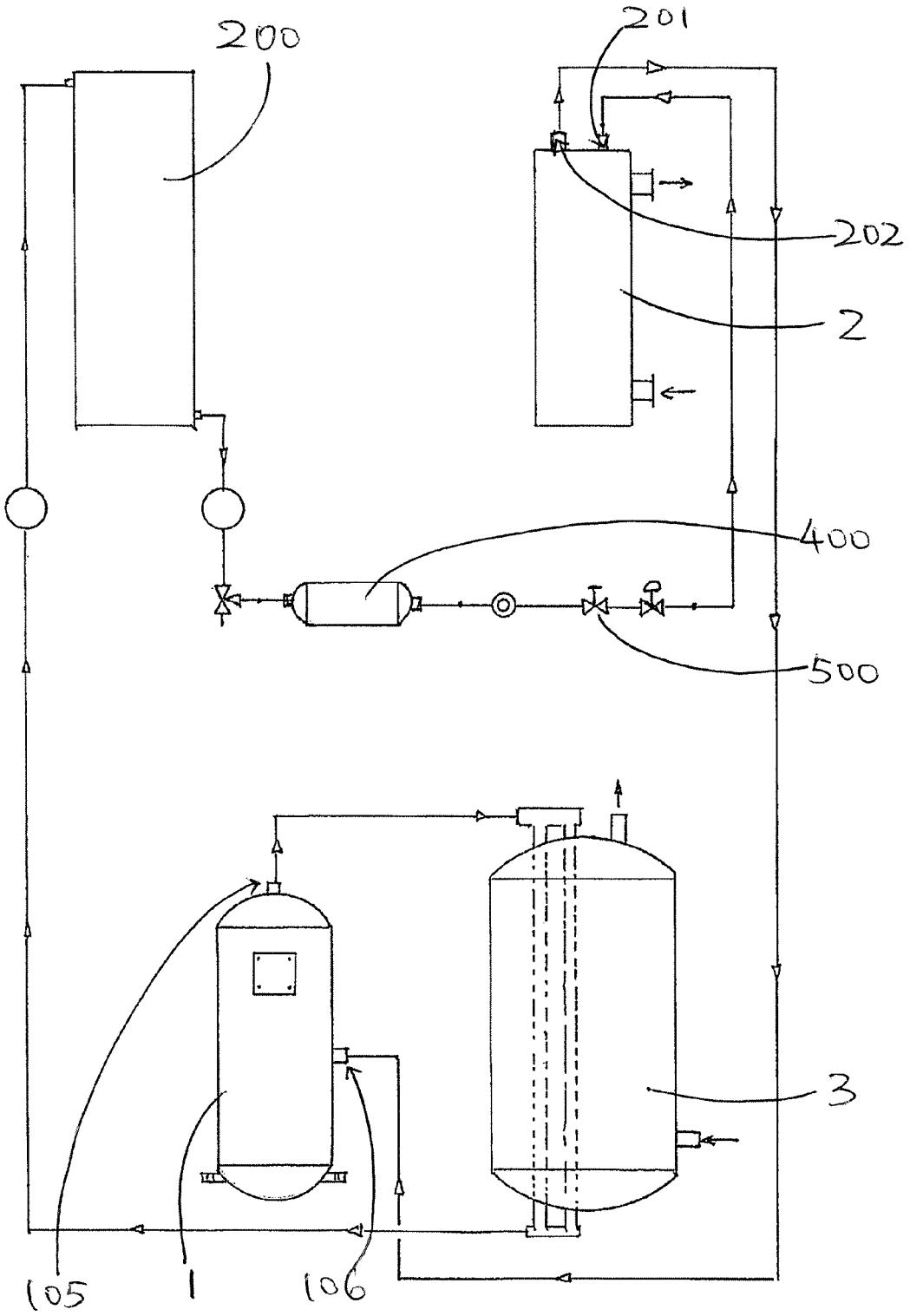
FIG. 29 illustrates block diagram of the air conditioning system according to the preferred embodiment of the present invention.

Referring to FIG. 29 of the drawings, a block diagram of the air conditioning system according to the preferred embodiment of the present invention is illustrated. The air conditioning system comprises the compressor unit 1, the water heater 3, the evaporative cooling system 200, the evaporator unit 2, a plurality of filter devices 400, and a plurality of expansion valves 500. The refrigerant circulates through the compressor unit 1, the water heater 3, an evaporator unit 2, the evaporative cooling system 200, the filter units 400, and the expansion valves 500 in the manner as shown in FIG. 29.

Specifically, steam or vaporous refrigerant leaves the compressor unit 1 through a compressor outlet 105. The compressor unit 1 is connected to the water heater 3. The refrigerant is guided to flow into the water heater 3 for extracting a predetermined amount of heat to incoming water so that the water in the water heater 3 is heated for being delivered to users of the present invention. The refrigerant then leaves the water heater 3 and enters the evaporative cooling system 200 which is connected to the water heater 3. The refrigerant is cooled by the evaporative cooling system 200 in the manner described above. The refrigerant then leaves the evaporative cooling system 200 and is arranged to flow through the filter devices 400, the expansion valves 500, and enter the evaporator unit 2 through an evaporator inlet 201. The refrigerant in the evaporator unit 2 is arranged to absorb heat from a space in which it is located and then leaves the evaporator unit 2 through an evaporator outlet 202. The refrigerant is then guided to flow back to the compressor unit 1 through a compressor inlet 106.

It is important to mention that in the specific system shown in FIG. 29, the air conditioning system is capable of producing cooled air and hot water. However, the water heater 3 in the above system is optional and the refrigerant coming from the compressor unit 1 may be guided to enter the evaporator cooling system 200 without passing through any water heater 3. This configuration is within the scope of the present invention.

The present invention, while illustrated and described in terms of a preferred embodiment and several alternatives, is not limited to the particular description contained in this specification. Additional alternative or equivalent components could also be used to practice the present invention.

What is claimed is:

1. An air conditioning system using a predetermined amount of working fluid, comprising:

an evaporator unit;

a compressor unit connected to said evaporator;

an evaporative cooling system which comprises at least one multiple-effect evaporative condenser connected to said compressor unit for effectively cooling said working fluid, said multiple-effect evaporative condenser comprising:

an air inlet side and an air outlet side which is opposite to said air inlet side;

a pumping device adapted for pumping a predetermined amount of cooling water at a predetermined flow rate;

a first cooling unit, comprising:

a first water collection basin for collecting said cooling water from said pumping device;

a plurality of first heat exchanging pipes connected to said condenser and immersed in said first water collection basin; and a first fill material unit provided underneath said first heat exchanging pipes, wherein said cooling water collected in said first water collection basin is arranged to sequentially flow through exterior surfaces of said first heat exchanging pipes and said first fill material unit;

a second cooling unit, comprising:

a second water collection basin positioned underneath said first cooling unit for collecting said cooling water flowing from said first cooling unit;

a plurality of second heat exchanging pipes immersed in said second water collection basin; and a second fill material unit provided underneath said second heat exchanging pipes, wherein said cooling water collected in said second water collection basin is arranged to sequentially flow through exterior surfaces of said second heat exchanging pipes and said second fill material unit; and a bottom water collecting basin positioned underneath said second cooling unit for collecting said cooling water flowing from said second cooling unit, the cooling water collected in said bottom water collection tank being arranged to be guided to flow back into said first water collection basin of said first cooling unit, said working fluid from said evaporator being arranged to flow through said first heat exchanging pipes of said first cooling unit and said second heat exchanging pipes of said second cooling unit in such a manner that said working fluid is arranged to perform highly efficient heat exchanging process with said cooling water for lowering a temperature of said working fluid, a predetermined amount of air being drawn from said air inlet side for performing heat exchange with said cooling water flowing through said first fill material unit and said second fill material unit for lowering a temperature of said cooling water, said air having absorbed said heat from said cooling water being discharged out of said first fill material unit and said second fill material unit through said air outlet side.

2. The air conditioning system, as recited in claim 1, wherein said first water collection basin has a first stabilizing compartment communicated with said pumping device, and a first heat exchanging compartment provided adjacent to and communicated with said first stabilizing compartment via a first water channel, wherein said first heat exchanging pipes are immersed in said first heat exchanging compartment.

3. The air conditioning system, as recited in claim 2, wherein said first water collection basin has a first inner sidewall, a first outer sidewall, a first partitioning wall, a first bottom plate, and a first passage plate, said first partitioning wall being provided between said first inner sidewall and said first outer sidewall to divide said first water collection basin into said first stabilizing compartment and said first heat exchanging compartment, said first water channel being formed on said first partitioning wall along a longitudinal direction thereof, said first stabilizing compartment being formed between said first inner sidewall, said first partitioning wall, and said first bottom plate, while said first heat exchanging compartment being formed by said first partitioning wall, said first outer sidewall, and said first passage plate.

4. The air conditioning system, as recited in claim 3, wherein said first water channel is elongated in shape and extend along a longitudinal direction of said first water collection basin so as to allow said cooling water to evenly flow into said first heat exchanging compartment along a longitudinal direction of said first heat exchanging pipes.

5. The air conditioning system, as recited in claim 4, wherein said first passage plate has a plurality of first passage holes for allowing said cooling water contained in said first heat exchanging compartment to fall into said first fill material unit, said first passage holes being distributed along said first passage plate in a predetermined array.

6. The air conditioning system, as recited in claim 5, wherein said first water collection basin further comprises a first supporting member securely mounted at a lower portion thereof, a plurality of top separating panels spacedly extended from a top ceiling of said first water collection basin, and a plurality of bottom separating panels spacedly extended from said supporting member to divide said first heat exchanging compartment into a plurality of heat exchanging chambers.

7. The air conditioning system, as recited in claim 6, wherein at least one of said first heat exchanging pipes is received in each of said heat exchanging chambers.

8. The air conditioning system, as recited in claim 5, wherein said multiple-effect evaporative condenser further comprises a flow control mechanism which comprises at least one control plate movably provided underneath said first passage plate of said first water collection basin, and at least one driving member connected to said first control plate for driving said control plate to move in a horizontal and reciprocal manner, said control plate having a plurality of control holes in which a number, a size, and a shape of said control holes are identical to those of said first passage holes, centers of said first passage holes being normally aligned with those of said control holes respectively.

9. The air conditioning system, as recited in claim 6, wherein said multiple-effect evaporative condenser further comprises a flow control mechanism which comprises at least one control plate movably provided underneath said first passage plate of said first water collection basin, and at least one driving member connected to said first control plate for driving said control plate to move in a horizontal and reciprocal manner, said control plate having a plurality of control holes in which a number, a size, and a shape of said control holes are identical to those of said first passage holes, centers of said first passage holes being normally aligned with those of said control holes respectively.

10. The air conditioning system, as recited in claim 8, wherein said flow control mechanism further comprises a plurality of securing members mounted on at least said first water collection basin and is arranged to normally exert an upward biasing force toward said control plate so as to maintain a predetermined distance between said control plate and said first passage plate.

11. The air conditioning system, as recited in claim 9, wherein said flow control mechanism further comprises a plurality of securing members mounted on at least said first water collection basin and is arranged to normally exert an upward biasing force toward said control plate so as to maintain a predetermined distance between said control plate and said first passage plate.

12. The air conditioning system, as recited in claim 10, wherein said first water collection basin further has a pair of first securing slots formed at lower portions of said first partitioning wall and said first outer sidewall respectively, each of said first securing slots being elongated along a longitudinal direction of said first water collection basin, said securing members being mounted in said first securing slots respectively.

13. The air conditioning system, as recited in claim 11, wherein said first water collection basin further has a pair of first securing slots formed at lower portions of said first partitioning wall and said first outer sidewall respectively, each of said first securing slots being elongated along a longitudinal direction of said first water collection basin, said securing members being mounted in said first securing slots respectively.

14. The air conditioning system, as recited in claim 12, wherein said flow control mechanism further comprises an automated control system operatively connected to at least one driving member, said automated control system comprising a central control unit, a connecting member connected between said central control unit and said driving member, and a sensor provided in said first water collection basin and electrically connected to said central control unit, said sensor being arranged to detect a water level in said first water collection basin and sends a signal to said central control unit, which is pre-programmed to respond to said signal of said sensor.

15. The air conditioning system, as recited in claim 13, wherein said flow control mechanism further comprises an automated control system operatively connected to at least one driving member, said automated control system comprising a central control unit, a connecting member connected between said central control unit and said driving member, and a sensor provided in said first water collection basin and electrically connected to said central control unit, said sensor being arranged to detect a water level in said first water collection basin and sends a signal to said central control unit, which is pre-programmed to respond to said signal of said sensor.

16. The air conditioning system, as recited in claim 2, wherein each of said multiple-effect evaporative condensers further comprises a bottom cooling unit for providing additional cooling of said working fluid, said bottom cooling unit comprising a guiding member, and a plurality of bottom heat exchanging pipes immersed in said bottom water collection basin, said working fluid being guided to pass through said bottom heat exchanging pipes and arranged to perform heat exchange with said cooling water contained in said bottom water collection basin.

17. The air conditioning system, as recited in claim 16, wherein each of said guiding members has a blocking portion, an inclined guiding portion, and a horizontal guiding portion extended between said blocking portion and said inclined guiding portion, said blocking portion upwardly extending from one end of said horizontal guiding portion, said inclined guiding portion downwardly extending from another end of said horizontal guiding portion, said guiding member being positioned above said bottom water collection basin, said inclined guiding portion being provided at said air inlet side of said corresponding multiple-effective evaporative condenser while said blocking portion being provided at said air outlet side thereof.

18. The air conditioning system, as recited in claim 17, wherein said multiple-effect evaporative condenser further comprises a pumping tank positioned adjacent to an inner side of said bottom water collection basin such that said cooling water is capable of flowing into said pumping tank which also accommodate said pumping device through a common sidewall between said bottom water collection basin and said pumping tank.

19. The air conditioning system, as recited in claim 1, wherein said second water collection basin has a second heat exchanging compartment, wherein said second heat exchanging pipes are immersed in said second heat exchanging compartment.

20. The air conditioning system, as recited in claim 14, wherein said second water collection basin has a second heat exchanging compartment, wherein said second heat exchanging pipes are immersed in said second heat exchanging compartment.

21. The air conditioning system, as recited in claim 15, wherein said second water collection basin has a second heat exchanging compartment, wherein said second heat exchanging pipes are immersed in said second heat exchanging compartment.

22. The air conditioning system, as recited in claim 19, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

23. The air conditioning system, as recited in claim 20, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

24. The air conditioning system, as recited in claim 21, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

25. The air conditioning system, as recited in claim 22, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

26. The air conditioning system, as recited in claim 23, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

27. The air conditioning system, as recited in claim 24, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

28. The air conditioning system, as recited in claim 19, wherein said second water collection basin further comprises a second supporting member securely mounted at a lower portion thereof, a plurality of top separating panels spacedly extended from a top ceiling of said second water collection basin, and a plurality of bottom separating panels spacedly extended from said supporting member to divide said second heat exchanging compartment into a plurality of heat exchanging chambers.

29. The air conditioning system, as recited in claim 27, wherein said second water collection basin further comprises a second supporting member securely mounted at a lower portion thereof, a plurality of top separating panels spacedly extended from a top ceiling of said second water collection basin, and a plurality of bottom separating panels spacedly extended from said supporting member to divide said second heat exchanging compartment into a plurality of heat exchanging chambers.

30. The air conditioning system, as recited in claim 28, wherein at least one of said second heat exchanging pipes is received in each of said heat exchanging chambers.

31. The air conditioning system, as recited in claim 29, wherein at least one of said second heat exchanging pipes is received in each of said heat exchanging chambers.

32. The air conditioning system, as recited in claim 1, wherein at least one of said first heat exchanging pipes comprises a first pipe body, a plurality of first retention members spacedly formed in said first pipe body, and a plurality of first heat exchanging fins extended from an inner surface of said first pipe body.

33. The air conditioning system, as recited in claim 32, wherein said first pipe body has two curved side portions and a substantially flat mid portion extending between said two curved side portions to form a rectangular cross sectional shape at said mid portion and two semicircular cross sectional shapes at two curved side portions of said corresponding first heat exchanging pipe.

34. The air conditioning system, as recited in claim 33, wherein said first retention members are spacedly distributed in said flat mid portion along a transverse direction of said corresponding pipe body so as to form a plurality of first pipe cavities, each of said first retention members having a predetermined elasticity for reinforcing a structural integrity of said corresponding first heat exchanging pipe, said first heat exchanging fins being are extended from an inner surface of said pipe body, and spacedly and evenly distributed along said inner surface of said pipe body.

35. The air conditioning system, as recited in claim 1, wherein at least one of said second heat exchanging pipes comprises a second pipe body and a plurality of second retention members spacedly formed in said second pipe body, and a plurality of second heat exchanging fins extended from an inner surface of said second pipe body.

36. The air conditioning system, as recited in claim 35, wherein said second pipe body has two curved side portions and a substantially flat mid portion extending between said two curved side portions to form a rectangular cross sectional shape at said mid portion and two semicircular cross sectional shapes at two curved side portions of said corresponding second heat exchanging pipe.

37. The air conditioning system, as recited in claim 36, wherein said second retention members are spacedly distributed in said flat mid portion along a transverse direction of said corresponding pipe body so as to form a plurality of second pipe cavities, each of said second retention members having a predetermined elasticity for reinforcing a structural integrity of said corresponding second heat exchanging pipe, said second heat exchanging fins being are extended from an inner surface of said pipe body, and spacedly and evenly distributed along said inner surface of said pipe body.

38. The air conditioning system, as recited in claim 1, wherein said first cooling unit further comprises a first guiding system connected to said first heat exchanging pipes for guiding said working fluid to flow through said first heat exchanging pipes in a predetermined order, said first guiding system comprising a first inlet collection pipe, a first guiding pipe, each of said first heat exchanging pipes having one end connected to first inlet collection pipe, and another end connected to said first guiding pipe, said first inlet collection pipe having a first fluid inlet, a first fluid outlet, and at least one first divider provided in said first inlet collection pipe.

39. The air conditioning system, as recited in claim 38, wherein said first guiding system further comprises a plurality of first heat exchanging fins extended between each two adjacent first heat exchanging pipes for substantially increasing a surface area of heat exchange between said first heat exchanging pipes and said cooling water, and for reinforcing a structural integrity of said first guiding system.

40. The air conditioning system, as recited in claim 39, wherein said first guiding system further comprises at least one first divider provided in said first guiding pipe for dividing said first guiding pipe into at least two portions.

41. The air conditioning system, as recited in claim 1, wherein said second cooling unit further comprises a second guiding system connected to said second heat exchanging pipes for guiding said working fluid to flow through said second heat exchanging pipes in a predetermined order, said second guiding system comprising a second inlet collection pipe, a second guiding pipe, each of said second heat exchanging pipes having one end connected to second inlet collection pipe, and another end connected to said second guiding pipe, said second inlet collection pipe having a second fluid inlet, a second fluid outlet, and at least one second divider provided in said second inlet collection pipe.

42. The air conditioning system, as recited in claim 41, wherein said second guiding system further comprises a plurality of second heat exchanging fins extended between each two adjacent second heat exchanging pipes for substantially increasing a surface area of heat exchange between said second heat exchanging pipes and said cooling water, and for reinforcing a structural integrity of said second guiding system.

43. The air conditioning system, as recited in claim 42, wherein said second guiding system further comprises at least one second divider provided in said second guiding pipe for dividing said second guiding pipe into at least two portions.

44. The air conditioning system, as recited in claim 1, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

45. The air conditioning system, as recited in claim 15, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

46. The air conditioning system, as recited in claim 27, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

47. The air conditioning system, as recited in claim 43, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

48. The air conditioning system, as recited in claim 1, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

49. The air conditioning system, as recited in claim 15, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

50. The air conditioning system, as recited in claim 27, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

51. The air conditioning system, as recited in claim 47, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

52. The air conditioning system, as recited in claim 48, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

53. The air conditioning system, as recited in claim 49, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

54. The air conditioning system, as recited in claim 50, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

55. The air conditioning system, as recited in claim 51, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

56. The air conditioning system, as recited in claim 1, wherein each of said first heat exchanging pipes and said second heat exchanging pipes are configured from aluminum and has a thin oxidation layer formed on an exterior surface and an interior surface for preventing corrosion.

57. The air conditioning system, as recited in claim 34, wherein each of said first heat exchanging pipes and said second heat exchanging pipes are configured from aluminum and has a thin oxidation layer formed on an exterior surface and an interior surface for preventing corrosion.

58. The air conditioning system, as recited in claim 37, wherein each of said first heat exchanging pipes and said second heat exchanging pipes are configured from aluminum and has a thin oxidation layer formed on an exterior surface and an interior surface for preventing corrosion.

59. The air conditioning system, as recited in claim 55, wherein each of said first heat exchanging pipes and said second heat exchanging pipes are configured from aluminum and has a thin oxidation layer formed on an exterior surface and an interior surface for preventing corrosion.

60. The air conditioning system, as recited in claim 56, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

61. The air conditioning system, as recited in claim 57, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

62. The air conditioning system, as recited in claim 58, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

63. The air conditioning system, as recited in claim 59, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

64. An evaporative cooling system comprising at least one multiple-effect evaporative condenser, which comprises:

an air inlet side and an air outlet side which is opposite to said air inlet side;

a pumping device adapted for pumping a predetermined amount of cooling water at a predetermined flow rate;

a first cooling unit, comprising:

a first water collection basin for collecting said cooling water from said pumping device;

a plurality of first heat exchanging pipes connected to said condenser and immersed in said first water collection basin; and a first fill material unit provided underneath said first heat exchanging pipes, wherein said cooling water collected in said first water collection basin is arranged to sequentially flow through exterior surfaces of said first heat exchanging pipes and said first fill material unit;

a second cooling unit, comprising:

a second water collection basin positioned underneath said first cooling unit for collecting said cooling water flowing from said first cooling unit;

a plurality of second heat exchanging pipes immersed in said second water collection basin; and a second fill material unit provided underneath said second heat exchanging pipes, wherein said cooling water collected in said second water collection basin is arranged to sequentially flow through exterior surfaces of said second heat exchanging pipes and said second fill material unit; and a bottom water collecting basin positioned underneath said second cooling unit for collecting said cooling water flowing from said second cooling unit, the cooling water collected in said bottom water collection tank being arranged to be guided to flow back into said first water collection basin of said first cooling unit, a predetermined amount of working fluid being arranged to flow through said first heat exchanging pipes of said first cooling unit and said second heat exchanging pipes of said second cooling unit in such a manner that said working fluid is arranged to perform highly efficient heat exchanging process with said cooling water for lowering a temperature of said working fluid, a predetermined amount of air being drawn from said air inlet side for performing heat exchange with said cooling water flowing through said first fill material unit and said second fill material unit for lowering a temperature of said cooling water, said air having absorbed said heat from said cooling water being discharged out of said first fill material unit and said second fill material unit through said air outlet side.

65. The evaporative cooling system, as recited in claim 64, wherein said first water collection basin has a first stabilizing compartment communicated with said pumping device, and a first heat exchanging compartment provided adjacent to and communicated with said first stabilizing compartment via a first water channel, wherein said first heat exchanging pipes are immersed in said first heat exchanging compartment.

66. The evaporative cooling system, as recited in claim 65, wherein said first water collection basin has a first inner sidewall, a first outer sidewall, a first partitioning wall, a first bottom plate, and a first passage plate, said first partitioning wall being provided between said first inner sidewall and said first outer sidewall to divide said first water collection basin into said first stabilizing compartment and said first heat exchanging compartment, said first water channel being formed on said first partitioning wall along a longitudinal direction thereof, said first stabilizing compartment being formed between said first inner sidewall, said first partitioning wall, and said first bottom plate, while said first heat exchanging compartment being formed by said first partitioning wall, said first outer sidewall, and said first passage plate.

67. The evaporative cooling system, as recited in claim 66, wherein said first water channel is elongated in shape and extend along a longitudinal direction of said first water collection basin so as to allow said cooling water to evenly flow into said first heat exchanging compartment along a longitudinal direction of said first heat exchanging pipes.

68. The evaporative cooling system, as recited in claim 67, wherein said first passage plate has a plurality of first passage holes for allowing said cooling water contained in said first heat exchanging compartment to fall into said first fill material unit, said first passage holes being distributed along said first passage plate in a predetermined array.

69. The evaporative cooling system, as recited in claim 68, wherein said first water collection basin further comprises a first supporting member securely mounted at a lower portion thereof, a plurality of top separating panels spacedly extended from a top ceiling of said first water collection basin, and a plurality of bottom separating panels spacedly extended from said supporting member to divide said first heat exchanging compartment into a plurality of heat exchanging chambers.

70. The evaporative cooling system, as recited in claim 69, wherein at least one of said first heat exchanging pipes are received in each of said heat exchanging chambers respectively.

71. The evaporative cooling system, as recited in claim 64, wherein said multiple-effect evaporative condenser further comprises a flow control mechanism which comprises at least one control plate movably provided underneath said first passage plate of said first water collection basin, and at least one driving member connected to said first control plate for driving said control plate to move in a horizontal and reciprocal manner, said control plate having a plurality of control holes in which a number, a size, and a shape of said control holes are identical to those of said first passage holes, centers of said first passage holes being normally aligned with those of said control holes respectively.

72. The evaporative cooling system, as recited in claim 69, wherein said multiple-effect evaporative condenser further comprises a flow control mechanism which comprises at least one control plate movably provided underneath said first passage plate of said first water collection basin, and at least one driving member connected to said first control plate for driving said control plate to move in a horizontal and reciprocal manner, said control plate having a plurality of control holes in which a number, a size, and a shape of said control holes are identical to those of said first passage holes, centers of said first passage holes being normally aligned with those of said control holes respectively.

73. The evaporative cooling system, as recited in claim 71, wherein said flow control mechanism further comprises a plurality of securing members mounted on at least said first water collection basin and is arranged to normally exert an upward biasing force toward said control plate so as to maintain a predetermined distance between said control plate and said first passage plate.

74. The evaporative cooling system, as recited in claim 72, wherein said flow control mechanism further comprises a plurality of securing members mounted on at least said first water collection basin and is arranged to normally exert an upward biasing force toward said control plate so as to maintain a predetermined distance between said control plate and said first passage plate.

75. The evaporative cooling system, as recited in claim 73, wherein said first water collection basin further has a pair of first securing slots formed at lower portions of said first partitioning wall and said first outer sidewall respectively, each of said first securing slots being elongated along a longitudinal direction of said first water collection basin, said securing members being mounted in said first securing slots respectively.

76. The evaporative cooling system, as recited in claim 74, wherein said first water collection basin further has a pair of first securing slots formed at lower portions of said first partitioning wall and said first outer sidewall respectively, each of said first securing slots being elongated along a longitudinal direction of said first water collection basin, said securing members being mounted in said first securing slots respectively.

77. The evaporative cooling system, as recited in claim 75, wherein said flow control mechanism further comprises an automated control system operatively connected to at least one driving member, said automated control system comprising a central control unit, a connecting member connected between said central control unit and said driving member, and a sensor provided in said first water collection basin and electrically connected to said central control unit, said sensor being arranged to detect a water level in said first water collection basin and sends a signal to said central control unit, which is pre-programmed to respond to said signal of said sensor.

78. The evaporative cooling system, as recited in claim 76, wherein said flow control mechanism further comprises an automated control system operatively connected to at least one driving member, said automated control system comprising a central control unit, a connecting member connected between said central control unit and said driving member, and a sensor provided in said first water collection basin and electrically connected to said central control unit, said sensor being arranged to detect a water level in said first water collection basin and sends a signal to said central control unit, which is pre-programmed to respond to said signal of said sensor.

79. The evaporative cooling system, as recited in claim 65, wherein each of said multiple-effect evaporative condensers further comprises a bottom cooling unit for providing additional cooling of said working fluid, said bottom cooling unit comprising a guiding member, and a plurality of bottom heat exchanging pipes immersed in said bottom water collection basin, said working fluid being guided to pass through said bottom heat exchanging pipes and arranged to perform heat exchange with said cooling water contained in said bottom water collection basin.

80. The evaporative cooling system, as recited in claim 79, wherein each of said guiding members has a blocking portion, an inclined guiding portion, and a horizontal guiding portion extended between said blocking portion and said inclined guiding portion, said blocking portion upwardly extending from one end of said horizontal guiding portion, said inclined guiding portion downwardly extending from another end of said horizontal guiding portion, said guiding member being positioned above said bottom water collection basin, said inclined guiding portion being provided at said air inlet side of said corresponding multiple-effective evaporative condenser while said blocking portion being provided at said air outlet side thereof.

81. The evaporative cooling system, as recited in claim 80, wherein said multiple-effect evaporative condenser further comprises a pumping tank positioned adjacent to an inner side of said bottom water collection basin such that said cooling water is capable of flowing into said pumping tank which also accommodate said pumping device through a common sidewall between said bottom water collection basin and said pumping tank.

82. The evaporative cooling system, as recited in claim 64, wherein said second water collection basin has a second heat exchanging compartment, wherein said second heat exchanging pipes are immersed in said second heat exchanging compartment.

83. The evaporative cooling system, as recited in claim 77, wherein said second water collection basin has a second heat exchanging compartment, wherein said second heat exchanging pipes are immersed in said second heat exchanging compartment.

84. The evaporative cooling system, as recited in claim 78, wherein said second water collection basin has a second heat exchanging compartment, wherein said second heat exchanging pipes are immersed in said second heat exchanging compartment.

85. The evaporative cooling system, as recited in claim 82, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

86. The evaporative cooling system, as recited in claim 83, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

87. The evaporative cooling system, as recited in claim 84, wherein said second water collection basin has a second inner sidewall, a second outer sidewall, and a second passage plate, said second heat exchanging compartment being defined within said second inner sidewall, said second outer sidewall, and said second passage plate, said second passage plate has a plurality of second passage holes for allowing said cooling water contained in said second heat exchanging compartment to fall onto said second fill material unit, said second passage holes being distributed along said second passage plate in a predetermined array.

88. The evaporative cooling system, as recited in claim 85, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

89. The evaporative cooling system, as recited in claim 86, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

90. The evaporative cooling system, as recited in claim 87, wherein said second water collection basin further has a pair of second securing slots formed at lower portions of said second inner side wall and said second outer sidewall respectively, each of said second securing slots being elongated and extended along a longitudinal direction of said second water collection basin, wherein at least two of said securing members being mounted in said second securing slots respectively.

91. The evaporative cooling system, as recited in claim 82, wherein said second water collection basin further comprises a second supporting member securely mounted at a lower portion thereof, a plurality of top separating panels spacedly extended from a top ceiling of said second water collection basin, and a plurality of bottom separating panels spacedly extended from said supporting member to divide said second heat exchanging compartment into a plurality of heat exchanging chambers.

92. The evaporative cooling system, as recited in claim 90, wherein said second water collection basin further comprises a second supporting member securely mounted at a lower portion thereof, a plurality of top separating panels spacedly extended from a top ceiling of said second water collection basin, and a plurality of bottom separating panels spacedly extended from said supporting member to divide said second heat exchanging compartment into a plurality of heat exchanging chambers.

93. The evaporative cooling system, as recited in claim 91, wherein at least one of said second heat exchanging pipes is received in each of said heat exchanging chambers.

94. The evaporative cooling system, as recited in claim 92, wherein at least one of said second heat exchanging pipes is received in each of said heat exchanging chambers.

95. The evaporative cooling system, as recited in claim 64, wherein at least one of said first heat exchanging pipes comprises a first pipe body, a plurality of first retention members spacedly formed in said first pipe body, and a plurality of first heat exchanging fins extended from an inner surface of said first pipe body.

96. The evaporative cooling system, as recited in claim 95, wherein said first pipe body has two curved side portions and a substantially flat mid portion extending between said two curved side portions to form a rectangular cross sectional shape at said mid portion and two semicircular cross sectional shapes at two curved side portions of said corresponding first heat exchanging pipe.

97. The evaporative cooling system, as recited in claim 96, wherein said first retention members are spacedly distributed in said flat mid portion along a transverse direction of said corresponding pipe body so as to form a plurality of first pipe cavities, each of said first retention members having a predetermined elasticity for reinforcing a structural integrity of said corresponding first heat exchanging pipe, said first heat exchanging fins being are extended from an inner surface of said pipe body, and spacedly and evenly distributed along said inner surface of said pipe body.

98. The evaporative cooling system, as recited in claim 64, wherein at least one of said second heat exchanging pipes comprises a second pipe body and a plurality of second retention members spacedly formed in said second pipe body, and a plurality of second heat exchanging fins extended from an inner surface of said second pipe body.

99. The evaporative cooling system, as recited in claim 98, wherein said second pipe body has two curved side portions and a substantially flat mid portion extending between said two curved side portions to form a rectangular cross sectional shape at said mid portion and two semicircular cross sectional shapes at two curved side portions of said corresponding second heat exchanging pipe.

100. The evaporative cooling system, as recited in claim 99, wherein said second retention members are spacedly distributed in said flat mid portion along a transverse direction of said corresponding pipe body so as to form a plurality of second pipe cavities, each of said second retention members having a predetermined elasticity for reinforcing a structural integrity of said corresponding second heat exchanging pipe, said second heat exchanging fins being are extended from an inner surface of said pipe body, and spacedly and evenly distributed along said inner surface of said pipe body.

101. The evaporative cooling system, as recited in claim 64, wherein said first cooling unit further comprises a first guiding system connected to said first heat exchanging pipes for guiding said working fluid to flow through said first heat exchanging pipes in a predetermined order, said first guiding system comprising a first inlet collection pipe, a first guiding pipe, each of said first heat exchanging pipes having one end connected to first inlet collection pipe, and another end connected to said first guiding pipe, said first inlet collection pipe having a first fluid inlet, a first fluid outlet, and at least one first divider provided in said first inlet collection pipe.

102. The evaporative cooling system, as recited in claim 101, wherein said first guiding system further comprises a plurality of first heat exchanging fins extended between each two adjacent first heat exchanging pipes for substantially increasing a surface area of heat exchange between said first heat exchanging pipes and said cooling water, and for reinforcing a structural integrity of said first guiding system.

103. The evaporative cooling system, as recited in claim 102, wherein said first guiding system further comprises at least one first divider provided in said first guiding pipe for dividing said first guiding pipe into at least two portions.

104. The evaporative cooling system, as recited in claim 64, wherein said second cooling unit further comprises a second guiding system connected to said second heat exchanging pipes for guiding said working fluid to flow through said second heat exchanging pipes in a predetermined order, said second guiding system comprising a second inlet collection pipe, a second guiding pipe, each of said second heat exchanging pipes having one end connected to second inlet collection pipe, and another end connected to said second guiding pipe, said second inlet collection pipe having a second fluid inlet, a second fluid outlet, and at least one second divider provided in said second inlet collection pipe.

105. The evaporative cooling system, as recited in claim 104, wherein said second guiding system further comprises a plurality of second heat exchanging fins extended between each two adjacent second heat exchanging pipes for substantially increasing a surface area of heat exchange between said second heat exchanging pipes and said cooling water, and for reinforcing a structural integrity of said second guiding system.

106. The evaporative cooling system, as recited in claim 105, wherein said second guiding system further comprises at least one second divider provided in said second guiding pipe for dividing said second guiding pipe into at least two portions.

107. The evaporative cooling system, as recited in claim 64, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

108. The evaporative cooling system, as recited in claim 78, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

109. The evaporative cooling system, as recited in claim 90, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

110. The evaporative cooling system, as recited in claim 106, wherein each of said multiple-effect evaporative condensers further comprises a pumping pipe assembly connecting said pumping device and said first cooling unit, said pumping pipe assembly having a main piping section which comprises a main pipe, and a plurality of branch piping sections each of which has at least one pumping pipe extended from said main pipe or a corresponding pumping pipe of a lower branch piping section.

111. The evaporative cooling system, as recited in claim 64, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

112. The evaporative cooling system, as recited in claim 78, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

113. The evaporative cooling system, as recited in claim 90, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

114. The evaporative cooling system, as recited in claim 110, wherein said first cooling unit further comprises a first water distributing panel having a plurality of distribution openings mounted between said first water collection basin and said first fill material unit of said first cooling unit for allowing said cooling water flowing from said first water collection basin to be evenly distributed into said first fill material unit along a transverse direction thereof.

115. The evaporative cooling system, as recited in claim 111, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

116. The evaporative cooling system, as recited in claim 112, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

117. The evaporative cooling system, as recited in claim 113, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

118. The evaporative cooling system, as recited in claim 114, wherein said second cooling unit further comprises a second water distributing panel having a plurality of distribution openings mounted between said second water collection basin and said second fill material unit of said second cooling unit for allowing said cooling water flowing from said second water collection basin to be evenly distributed onto said second fill material unit along a transverse direction thereof.

119. The evaporative cooling system, as recited in claim 64, wherein each of said first heat exchanging pipes and said second heat exchanging pipes are configured from aluminum and has a thin oxidation layer formed on an exterior surface and an interior surface for preventing corrosion.

120. The evaporative cooling system, as recited in claim 97, wherein each of said first heat exchanging pipes and said second heat exchanging pipes are configured from aluminum and has a thin oxidation layer formed on an exterior surface and an interior surface for preventing corrosion.

121. The evaporative cooling system, as recited in claim 100, wherein each of said first heat exchanging pipes and said second heat exchanging pipes are configured from aluminum and has a thin oxidation layer formed on an exterior surface and an interior surface for preventing corrosion.

122. The evaporative cooling system, as recited in claim 118, wherein each of said first heat exchanging pipes and said second heat exchanging pipes are configured from aluminum and has a thin oxidation layer formed on an exterior surface and an interior surface for preventing corrosion.

123. The evaporative cooling system, as recited in claim 119, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

124. The evaporative cooling system, as recited in claim 120, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

125. The evaporative cooling system, as recited in claim 121, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

126. The evaporative cooling system, as recited in claim 122, wherein each of said first heat exchanging pipes and said second heat exchanging pipes has a thin layer of polytetrafluoroethylene formed on said exterior surface and an interior surface of said corresponding first heat exchanging pipes and said second heat exchanging pipes.

* * * * *